US012473168B2

(12) United States Patent
Cini

(10) Patent No.: US 12,473,168 B2
(45) **Date of Patent: *Nov. 18, 2025**

(54) UNWINDER WITH AUTOMATIC SWITCHING OF THE UNWINDING ROLL

(71) Applicant: CRC S.R.L., Capannori (IT)

(72) Inventor: Enrico Cini, Capannori (IT)

(73) Assignee: CRC S.R.L., Capannori (IT)

( * ) Notice: Subject to any disclaimer, the term of this patent is extended or adjusted under 35 U.S.C. 154(b) by 110 days.

This patent is subject to a terminal disclaimer.

(21) Appl. No.: 18/031,198

(22) PCT Filed: Oct. 11, 2021

(86) PCT No.: PCT/EP2021/078074

§ 371 (c)(1),
(2) Date: Apr. 11, 2023

(87) PCT Pub. No.: WO2022/078969

PCT Pub. Date: Apr. 21, 2022

(65) Prior Publication Data

US 2023/0373745 A1 Nov. 23, 2023

(30) Foreign Application Priority Data

Oct. 12, 2020 (IT) ..... 102020000023980

(51) Int. Cl.
*B65H 19/18* (2006.01)
*B65H 23/032* (2006.01)

(52) U.S. Cl.
CPC ..... *B65H 19/1852* (2013.01); *B65H 19/1873* (2013.01); *B65H 23/0326* (2013.01); (Continued)

(58) Field of Classification Search
CPC ..... B65H 19/18; B65H 19/1852; B65H 19/1873; B65H 23/0326; B65H 23/032
See application file for complete search history.

(56) References Cited

U.S. PATENT DOCUMENTS 3,891,158 A * 6/1975 Shearon ..... B65H 19/1873 242/556.1
9,216,861 B2 * 12/2015 Adachi ..... B65G 43/00
(Continued)

FOREIGN PATENT DOCUMENTS

EP 1027272 A1 8/2000
WO 9841464 A1 9/1998

*Primary Examiner* — Sang K Kim

(74) *Attorney, Agent, or Firm* — McGlew and Tuttle, P.C.

(57) ABSTRACT

Unwinder of a thin ply product wound on a roll, of the type with automatic switching of the unwinding roll with a spare roll, said unwinder comprising—a first roll-holder assembly equipped with a first unwinding rod for a respective roll, on which the roll is adapted to be supported, and which has an axis of rotation transversal to the direction of movement of the ply unwound from the roll,—a second roll-holder assembly equipped with a second unwinding rod for a respective roll, on which the roll is adapted to be supported, said second rod being parallel to said first unwinding rod of the first roll-holder assembly, said second roll-holder assembly facing said first roll-holder assembly in an unwinding zone, wherein of said two roll-holder assemblies, one assembly holds the unwinding roll and the other assembly holds the spare roll to be switched,—a ply splicing assembly placed above said first and second facing roll-holder assemblies,—a ply accumulation unit to allow automatic switching between a roll being unwound in one said roll-holder assembly and a spare roll provided in the other roll-holder assembly,—a transversal position correction system for the side edges of the plies on the rolls present in said roll-holder assemblies.

14 Claims, 23 Drawing Sheets

(52) U.S. Cl.
CPC ..... *B65H 2301/413243* (2013.01); *B65H 2301/46013* (2013.01); *B65H 2301/46024* (2013.01); *B65H 2301/4622* (2013.01); *B65H 2301/4625* (2013.01); *B65H 2301/4631* (2013.01); *B65H 2553/30* (2013.01); *B65H 2553/412* (2013.01); *B65H 2701/1311* (2013.01); *B65H 2701/1313* (2013.01); *B65H 2701/1315* (2013.01)

(56) References Cited

U.S. PATENT DOCUMENTS

| | | | | |
|---|---|---|---|---|
| 9,486,828 | B2 * | 11/2016 | Miura | B05C 5/005 |
| 10,301,134 | B2 * | 5/2019 | Gnan | B65H 19/20 |
| 10,696,507 | B2 * | 6/2020 | Reichl | B65H 19/1852 |
| 2005/0241774 | A1 | 11/2005 | Hart et al. | |

* cited by examiner

UNWINDER WITH AUTOMATIC SWITCHING OF THE UNWINDING ROLL

TECHNICAL FIELD

The present invention relates to the field of processing plants for thin products wound on a roll, such as the production of paper products from a paper product wound on a roll, or the production of products made of film or nonwoven materials.

In particular, but not exclusively, the invention relates to the printing of thin products wound on a roll, such as the printing of self-adhesive labels or the printing of card or plastic film for packaging.

More in particular, the present invention relates to an unwinder of a thin ply product wound on a roll, in particular, but not exclusively adapted to be arranged in plants for printing on thin products on a roll.

BACKGROUND ART

As is known, printing on thin products (i.e., plies, tapes, etc.) wound on a roll generally takes place on production lines composed of several modules arranged in sequence, of which the first machine of the line is generally an unwinder of rolls of thin products that are to be printed.

A roll loaded onto the unwinder feeds the printing line until it runs out, and when this condition occurs, in order to allow production to continue another roll must loaded for unwinding.

In the simplest unwinders, when the roll runs out, the line is stopped, the product is cut by the operator, the empty roll is removed, a new roll is loaded onto the machine and the edge of the new roll is connected to the edge of the product previously cut by means of different systems, in the majority of cases using adhesive tape.

The manual roll switching process has two main sources of inefficiency, the first linked to the time required for the operator to switch the roll manually, time in which the production line is idle, while the second is linked to the fact that, in order to be able to switch the roll manually the line must be shut down and this implies a stoppage of printing, which makes it necessary to discard a substantial amount of product.

For these reasons, unwinders with automatic roll switching capable of solving these problems have been placed on the market.

In these types of machines splicing must not be an overlap splice, but a butt splice. The main reason is that the overlapping of several plies would create a thickness that could damage other devices present in the line, such as cliché rollers and punching plates.

Unwinders with automatic roll switching currently present on the market have the peculiarity of being provided with a system that allows accumulation of a certain amount of product, hereinafter called "ply accumulator".

During the time required by the unwinder to carry out the automatic roll switching sequence, the unwinding speed is zero and the product present in the ply accumulator feeds the line and prevents the stoppage of printing, while the operations to cut and glue the plies are entrusted to a system of wheels, blades and rollers.

However, these unwinders with automatic roll switching have some critical points.

A first critical point is linked to poor ergonomics of the unwinder, which makes it difficult for many of the operations carried out by the operator who, for example, has to prepare the plies for splicing during roll switching.

A second critical point is linked to problems of misalignment of the two spliced plies, which causes product wastage and non-conforming products.

A third critical point is linked, during set-up of the unwinder, to insertion of the ply from the roll into the unwinding path, which is generally complicated for the operator, who requires to work inside narrow and high parts of the machine, often using ladders to access the highest parts, with a risk to personal safety.

SUMMARY

The object of the present invention is to solve the problems and weak points linked to unwinders of products wound on a roll of the aforesaid type, and to improve existing unwinders.

Therefore, an important object of the present invention is to produce an unwinder of a thin ply product wound on a roll that allows problems of misalignment between the edges of the ply of the unwinding roll and the ply of the spare roll to be avoided.

Another important object of the present invention is to produce an unwinder of a thin ply product wound on a roll that allows easy loading of a spare roll to facilitate roll switching.

A further important object of the present invention is to produce an unwinder of a thin ply product wound on a roll that facilitates the operations to prepare splicing of the leading edge of the ply on the spare roll to the trailing edge of the unwinding roll about to run out.

Yet another important object of the present invention is to produce an unwinder of a thin ply product wound on a roll that facilitates the preparation steps of the ply inside the unwinder, and in particular inside the accumulation unit of the unwinder.

These and other objects, which will be more apparent below, are achieved with an unwinder of a thin ply product wound on a roll according to the appended claims.

More in particular, according to a first aspect, the invention relates to an unwinder of a thin ply product wound on a roll of the type with automatic switching of the unwinding roll with a spare roll, said unwinder comprising

- a first roll-holder assembly equipped with a first unwinding rod for a respective roll, on which the roll is adapted to be supported, and which has an axis of rotation transversal to the direction of movement of the ply unwound from the roll,
- a second roll-holder assembly equipped with a second unwinding rod of a respective roll, on which the roll is adapted to be supported, said second rod being parallel to said first unwinding rod of the first roll-holder assembly, said second roll-holder assembly facing said first roll-holder assembly in an unwinding zone, wherein of said two roll-holder assemblies, one assembly carries the unwinding roll and the other assembly carries the spare roll to be replaced,
- a ply splicing assembly placed above said first and second facing roll-holder assemblies,
- a ply accumulation unit to allow automatic switching between a roll being unwound in one said roll-holder assembly and a spare roll provided in the other roll-holder assembly,
- a transversal position correction system for the side edges of the plies on the rolls present in said roll-holder assemblies.

According to preferred embodiments, the transversal position correction system for the side edges of the plies on the rolls present in said roll-holder assembly comprises an automatic guide device for the side edge of the ply on the unwinding roll, adapted to enable said edge to maintain a substantially constant axial position during unwinding.

Preferably, the automatic guide device comprises at least one sensor adapted to detect the position or presence in a certain position of the edge of the ply on the unwinding roll, said at least one sensor being associated with a pre-determined optimal position for the edge of the ply during unwinding; said automatic guide device further comprising a device for changing the axial position of the unwinding rod, adapted to move the rod in a direction and for a distance such as to return the side edge to the optimal position in the event that said first sensor detects a position that does not conform with the optimal position.

Preferably, the device for changing the axial position of the unwinding rod comprises a movement actuator for said unwinding rod, i.e. for said roll-holder assembly with the unwinding roll.

According to some preferred embodiments, the transversal position correction system for the side edges of the plies on the rolls present in said roll-holder assembly comprises a device for aligning a side edge of the leading edge of the ply on the spare roll with a corresponding side edge of the ply on the unwinding roll when both rolls are in said unwinding zone, which in turn comprises a device for verifying the alignment of said side edges of the spare roll and the unwinding roll, and a device for correcting any misalignment detected.

Preferably, this edge alignment verification device comprises at least one first sensor adapted to detect the position or presence in said position of the edge of the ply on the unwinding roll, and at least one second sensor adapted to detect the position or presence in a certain position of the edge of the leading edge of the spare roll which has to be spliced; preferably said at least two sensors are operationally connected to an electronic unwinder control system, and when said electronic system verifies that the two edges are not in the same position, i.e. they are not aligned, it orders said misalignment correction device to change the position of one of the two edges and more preferably to change the position of the edge of the leading edge of the ply on the spare roll which has to be spliced with the ply on the unwinding roll.

Preferably, the misalignment correction device comprises a system for moving the spare roll in the direction of correction; preferably said movement system causing the movement of the unwinding rod, on which the spare roll is mounted, in an axial direction by an amount equivalent to the misalignment measurement; preferably said system for moving the spare roll in the direction of correction comprises a system for the lateral movement of one said unwinding rod with respect to said unwinding zone, to enable the translation in a transversal direction of the roll-holder assembly with the spare roll.

According to other preferred embodiments, the unwinder further comprises a system for the lateral movement of each of said unwinding rods with respect to said unwinding zone, from said unwinding zone to a loading zone wherein said rolls are outside said winding zone to facilitate loading the rolls into the respective roll-holder assemblies.

Preferably, the unwinder defines an unwinding path for the ply on the unwinding roll, which starts from the roll-holder assembly with the unwinding roll, passes in succession through the splicing assembly, the accumulation unit, to the exit of the unwinder.

Preferably, the unwinder is of the type with automatic switching of the unwinding roll with the spare roll provided on two roll-holder assemblies.

Preferably, at least one said roll-holder assembly comprises a transversal guide system associated with said unwinding rod, to allow the transversal movement of said support rod between said unwinding zone and said loading zone.

Preferably, at least one said roll-holder assembly comprises a support frame from which said unwinding rod projects, and wherein said lateral movement system comprises a guide for said support frame with said unwinding rod to slide along, preferably on the ground.

Even more preferably, the lateral movement system provides a manual movement action, i.e. carried out by the arms of an operator.

In some embodiments, a system for relieving the inertial movement of said roll-holder assembly could be provided.

According to preferred embodiments, at least one said roll-holder assembly comprises a device for the downward movement, and vice versa, of said unwinding rod, enabling the rod to be lowered to a distance from the ground such as to allow the roll to be loaded onto it and then enabling the rod with the loaded roll to be raised again to an unwinding height.

Advantageously, the downward movement device can comprise a downward translation guide, fixed to said support frame, and a slide placed slidingly on said downward translation guide, said unwinding rod being placed on said slide, preferably together with the rod rotation motor; preferably, said downward movement device comprises a movement actuator, fixed to said support frame and adapted to interact in a push/pull manner with said slide so as to enable vertical movement of the unwinding rod with or without a roll.

According to preferred embodiments, the splicing assembly can be moved from a working position above the two said roll-holder assemblies in said unwinding zone, to a working position above the extracted roll assembly in the loading zone, to allow preparation for splicing of the leading edge of the ply wound on the spare roll.

Preferably, the splicing assembly comprises an apparatus for moving the assembly from the working position in said unwinding zone to the other working position above said roll-holder assembly moved from the working zone.

Preferably, the splicing assembly comprises a support structure for at least part of the components of the splicing assembly, and wherein said apparatus for moving the splicing assembly comprises at least one transversal sliding and support guide preferably associated with, or fixed to, the unwinder ground support frame and extending from the unwinding zone towards the loading zone, on said at least one guide said support structure being slidingly arranged.

According to some examples, the splicing assembly comprises a support structure for at least part of the components of the splicing assembly, in which there is a nip for the passage in a downward direction of the leading edge of the ply wound on the spare roll and for the ply of the unwinding roll; said nip, in addition to offering a downward passage, is preferably also open in the direction of the unwinding zone, to allow the entry/exit of the ply of the unwinding roll from said nip during the transversal movement of the splicing assembly; said nip preferably dividing said splicing assembly into two parts, one part relating mainly to splicing the leading edge of the ply on the spare roll when present in said first roll-holder assembly, and one part relating mainly to splicing the leading edge of the ply on the spare roll when present in said second roll-holder assembly.

Preferably, the splicing assembly comprises at least one device for cutting the leading edge of the ply wound on the spare roll, and a contrasting device for holding the ply against a contrasting wall positioned within said nip; preferably, said cutting device also has a contrasting portion against said contrasting wall; preferably the direction of cutting being oblique to and inclined with respect to the width of the ply.

Advantageously, in some examples, the splicing assembly can also comprise assembly a pair of controlled adhesion surfaces placed above said nip and on opposing sides of the path of movement of the ply in said nip, so as to allow, upon activation of the adhesion function, adhesion of a portion of adhesive tape to be fixed to the ends of the plies to be spliced in said splicing assembly; preferably said adhesion surfaces being aspirating surfaces, and more preferably said surfaces are the surfaces of aspirating rollers; preferably there being present means for moving the aspirating surfaces towards the path of movement taken by the ply exiting said nips. Aspiration holds only the adhesive tape blocked on the outer surface of the roller: when the ply encounters the adhesive of the tape, the adhesive force overcomes the aspiration force and the tape is deposited on the ply by the aspirating roller.

According to preferred embodiments, the splicing assembly comprises an apparatus for blocking the splicing assembly to the extracted roll-holder assembly, by which said splicing assembly is blocked in turn to said first and said second roll-holder assembly, when extracted, said blocking continuing even when said splicing assembly and the relative roll-holder assembly are jointly brought (i.e. as a single unit) into the unwinding zone.

Preferably, the unwinder comprises one said movement system for each said roll-holder assembly so as to correct the positioning of the roll when it is a spare roll, there being thus present one said automatic movement device for each roll-holder assembly.

According to preferred embodiments, the ply accumulation unit comprises a ply accumulation path comprising a plurality of accumulation sections overlapping at least in part, between deviator rollers for the ply, and a ply feed apparatus downstream of the accumulation unit, wherein, downstream of the accumulation unit, feeding of the ply contained in said accumulation sections is achieved by varying the length of at least some of said accumulation sections, said accumulation unit also comprising a section for the insertion of the leading edge of the ply to be accumulated, between at least some of the deviator rollers of said accumulation path and a device for the automated insertion of the leading edge of the ply to be accumulated in said insertion section.

Preferably, the ply feed apparatus downstream of the accumulation unit comprises a first series of fixed deviator rollers, whose axes of rotation lie on a first surface, and a second series of deviator rollers placed on a movable trolley, whose axes of rotation lie on a second surface, said trolley being movable from a first maximum accumulation position, wherein said second series of rollers is spaced from said first series of rollers, with said second surface positioned on a first side of said first surface, and a second position in which said second series of rollers is arranged close to said first series, with said second surface positioned on the second side of said first surface opposite the first side, so that feeding downstream of the accumulation unit is achieved by moving said trolley from said first position towards said second position; wherein said section for insertion of the leading edge of the ply on the roll to be unwound is between said first and second series of rollers when in said second position, so that when the leading edge of the ply has passed said insertion section, said trolley is adapted to be moved to said first position with said second series of rollers that pull the ply towards said second position, thereby creating said accumulation sections.

For example, the insertion section is upward, preferably vertical.

According to preferred embodiments, the accumulation unit comprises a section for extraction from the accumulation unit for the leading edge of the ply to be accumulated, defined on the side of said second surface of the second series of rollers, when the trolley is in said second position, opposite the side of the second surface facing said first surface; preferably said extraction section is upwards, preferably vertical.

Preferably, in accumulation unit, the device for the automated insertion of the leading edge of the ply to be accumulated comprises a gripper device for the leading edge of the ply to be accumulated, adapted to pass through said insertion section and said extraction section, preferably passing above an upper deviator roller between said insertion section and extraction section.

According to preferred embodiments, in the accumulation unit, the device for the automated insertion of the leading edge of the ply to be accumulated comprises a flexible element, to one end of which is attached said gripper device, and a device for adjusting the distance of said gripper device from a device for the pick-up or release of said flexible element so as to consent the movement of said gripper device along said insertion and extraction sections.

According to a second aspect, the invention also relates to an unwinder of a thin ply product wound on a roll, of the type with automatic switching of the unwinding roll with a spare roll, said unwinder comprising

- a first roll-holder assembly equipped with a first unwinding rod for a respective roll, on which the roll is adapted to be supported, and which has an axis of rotation transversal to the direction of movement of the ply unwound from the roll,
- a second roll-holder assembly equipped with a second unwinding rod of a respective roll, on which the roll is adapted to be supported, said second rod being parallel to said first unwinding rod of the first roll-holder assembly, said second roll-holder assembly facing said first roll-holder assembly in an unwinding zone, wherein of said two roll-holder assemblies, one assembly carries the unwinding roll and the other assembly carries the spare roll to be replaced,
- a ply splicing assembly placed above said first and second facing roll-holder assemblies,
- a ply accumulation unit to allow automatic switching between a roll being unwound in one said roll-holder assembly and a spare roll provided in the other roll-holder assembly,
- a system for the lateral movement of each of said unwinding rods with respect to said unwinding zone, from said unwinding zone to a loading zone wherein said rolls are outside said winding zone to facilitate loading the rolls into the respective roll-holder assemblies.

Advantageously, other features of this second aspect of the invention are to be considered as those inherent to said alignment device already proposed in the embodiments associated with the first aspect of the invention.

According to a third aspect, the invention relates to an unwinder of a thin ply product wound on a roll, of the type with automatic switching of the unwinding roll with a spare roll, according to the following first clause:

1. Unwinder of a thin ply product wound on a roll, of the type with automatic switching of the unwinding roll with a spare roll, said unwinder comprising
   - a first roll-holder assembly equipped with a first unwinding rod for a respective roll, on which the roll is adapted to be supported, and which has an axis of rotation transversal to the direction of movement of the ply unwound from the roll,
   - a second roll-holder assembly equipped with a second unwinding rod of a respective roll, on which the roll is adapted to be supported, said second rod being parallel to said first unwinding rod of the first roll-holder assembly, said second roll-holder assembly facing said first roll-holder assembly in an unwinding zone, wherein of said two roll-holder assemblies, one assembly carries the unwinding roll and the other assembly carries the spare roll to be replaced,
   - a ply splicing assembly placed above said first and second facing roll-holder assemblies,
   - a ply accumulation unit to allow automatic switching between a roll being unwound in one said roll-holder assembly and a spare roll provided in the other roll-holder assembly, wherein said ply accumulation unit comprises an accumulation path of the ply comprising a plurality of accumulation sections overlapping at least in part, between deviator rollers for the ply, and a ply feed apparatus downstream of the accumulation unit, wherein, downstream of the accumulation unit, feeding of the ply contained in said accumulation sections is achieved by varying the length of at least some of said accumulation sections, said accumulation unit also comprising a section for the insertion of the leading edge of the ply to be accumulated, between at least some of the deviator rollers of said accumulation path and a device for the automated insertion of the leading edge of the ply to be accumulated in said insertion section.

Various details and embodiments of the third aspect of the invention as in clause 1 indicated above are presented in the following clauses:

2. Unwinder according to clause 1, wherein said ply feed apparatus downstream of the accumulation unit comprises a first series of fixed deviator rollers, whose axes of rotation lie on a first surface, and a second series of deviator rollers placed on a movable trolley, whose axes of rotation lie on a second surface, said trolley being movable from a first maximum accumulation position, wherein said second series of rollers is spaced from said first series of rollers, with said second surface positioned on a first side of said first surface, and a second position in which said second series of rollers is arranged close to said first series, with said second surface positioned on the second side of said first surface opposite the first side, so that feeding downstream of the accumulation unit is achieved by moving said trolley from said first position towards said second position; wherein said section for insertion of the leading edge of the ply on the roll to be unwound is between said first and second series of rollers when in said second position, so that when the leading edge of the ply has passed said insertion section, said trolley is adapted to be moved to said first position with said second series of rollers that pull the ply towards said second position, thereby creating said accumulation sections.
3. Unwinder according to clause 1 or 2, wherein said accumulation unit comprises a section for extraction from the accumulation unit for the leading edge of the ply to be accumulated, defined on the side of said second surface of the second series of rollers, when the trolley is in said second position, opposite the side of the second surface facing said first surface; preferably said extraction section is upwards, preferably vertical.
4. Unwinder according to clause 3, wherein the device for the automated insertion of the leading edge of the ply to be accumulated comprises a gripper device for the leading edge of the ply to be accumulated, adapted to pass through said insertion section and said extraction section, preferably passing above an upper deviator roller between said insertion section and extraction section.
5. Unwinder according to one or more of the preceding clauses, wherein said device for the automated insertion of the leading edge of the ply to be accumulated comprises a flexible element, to one end of which is attached said gripper device, and a device for adjusting the distance of said gripper device from a device for the pick-up or release of said flexible element so as to consent the movement of said gripper device along said insertion and extraction sections.
6. Unwinder according to one or more of the preceding clauses, wherein said insertion section is upward, preferably vertical.
7. Unwinder according to one or more of the preceding clauses, comprising a system for the lateral movement of each of said unwinding rods with respect to said unwinding zone, from said unwinding zone to a loading zone wherein said rolls are outside said winding zone to facilitate loading the rolls into the respective roll-holder assemblies, and wherein said splicing assembly can be moved from a working position above the two said roll-holder assemblies in said unwinding zone, to a working position above the extracted roll assembly in the loading zone, to allow preparation for splicing of the leading edge of the ply wound on the spare roll.
8. Unwinder according to one or more of the preceding clauses, comprising an automatic guide device for the side edge of the ply on the unwinding roll, adapted to enable said edge to maintain a substantially constant axial position during unwinding; preferably, said automatic guide device comprises at least one sensor adapted to detect the position or presence in a certain position of the edge of the ply on the unwinding roll, said at least one sensor being associated with a predetermined optimal position for the edge of the ply during unwinding; said automatic guide device further comprising a device for changing the axial position of the unwinding rod, adapted to move the rod in a direction and for a distance such as to return the side edge to the optimal position in the event that said first sensor detects a position that does not conform with the optimal position; preferably, said device for changing the axial position of the unwinding rod comprising a movement actuator for said unwinding rod, i.e. for said roll-holder assembly with the unwinding roll.
9. Unwinder according to clause 8, wherein said device for changing the axial position of the unwinding rod comprises said system for the lateral movement of one said unwinding rod with respect to said unwinding zone, to enable the translation in a transversal direction of the roll-holder assembly with the unwinding roll, and an automatic movement device for said unwinding rod; preferably said automatic movement device comprising an actuator acting on the support frame of the respective roll-holder assembly in order to translate the support frame with the unwinding rod by an amount equivalent to the change measurement.

10. Unwinder according to one or more of the preceding clauses, comprising a device for aligning a side edge of the leading edge of the ply on the spare roll with a corresponding side edge of the ply on the unwinding roll when both rolls are in said unwinding zone, which in turn comprises a device for verifying the alignment of said side edges of the spare roll and the unwinding roll, and a device for correcting any misalignment detected.

Advantageously, other features of this third aspect of the invention are to be considered those inherent to said accumulation unit already proposed in the embodiments associated with the first aspect of the invention.

BRIEF DESCRIPTION OF THE DRAWINGS

The invention will now be better understood by following the description and accompanying drawings, which illustrate a non-limiting example of embodiment of the invention. More in particular, in the drawing.

DETAILED DESCRIPTION OF EMBODIMENTS

Figure 1:
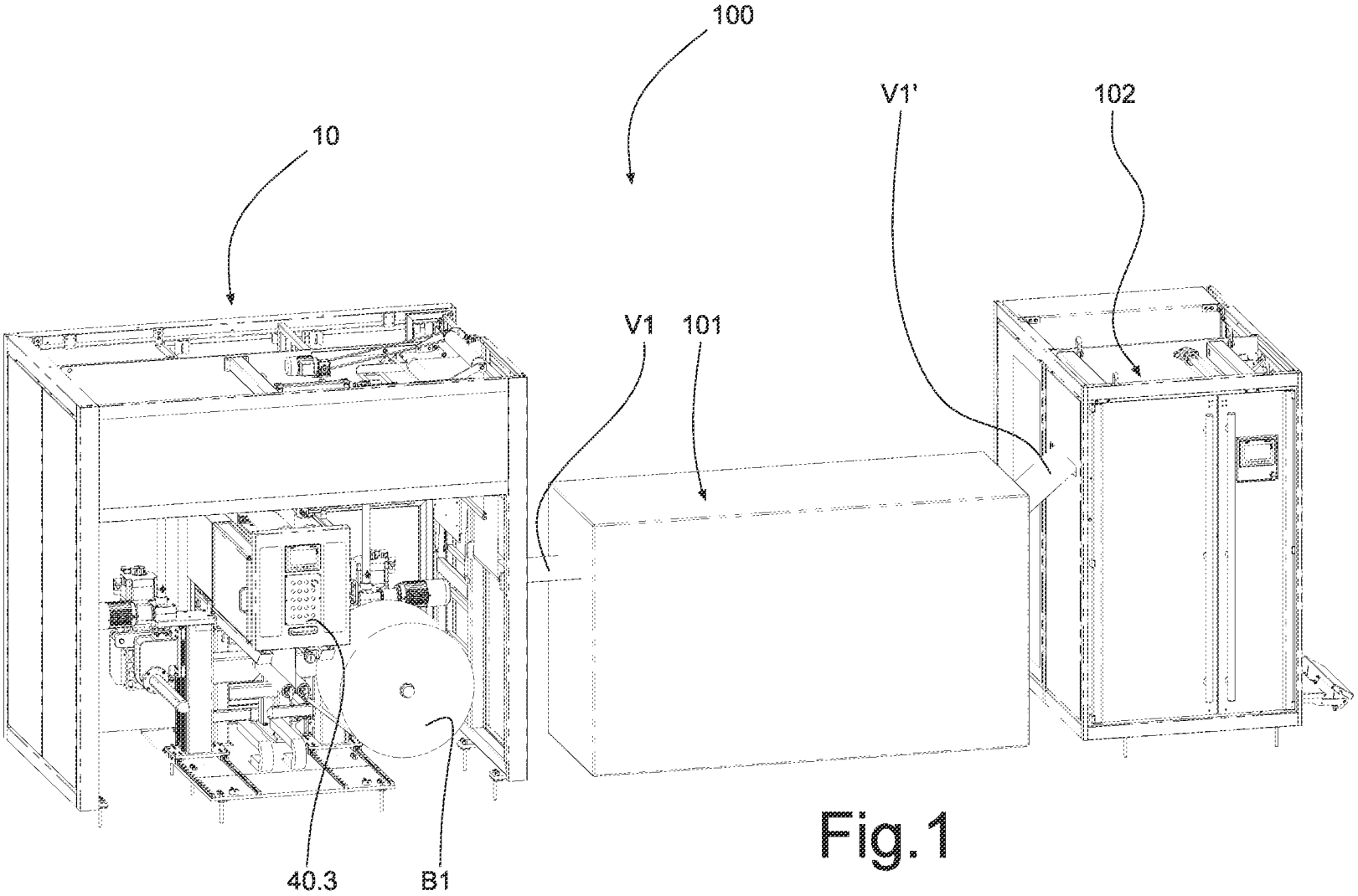
FIG. 1 represents a schematic side view of a plant with unwinder according to the invention.

With reference to the aforesaid figures, an unwinder of a thin product, i.e., a ply wound on a roll adapted to be printed, according to the invention, is indicated as a whole with the number 10.

This unwinder is, for example, included in a printing plant (schematized in FIG. 1), indicate as a whole with 100, which in turn comprises a printing machine 101, into which an endless ply V1 of a thin product coming from the unwinder 10 is adapted to be inserted in order to be printed, and a winding device 102, in which the printed ply V1' in the printing machine 101 is adapted to be collected in the form of a new roll.

Figure 2:
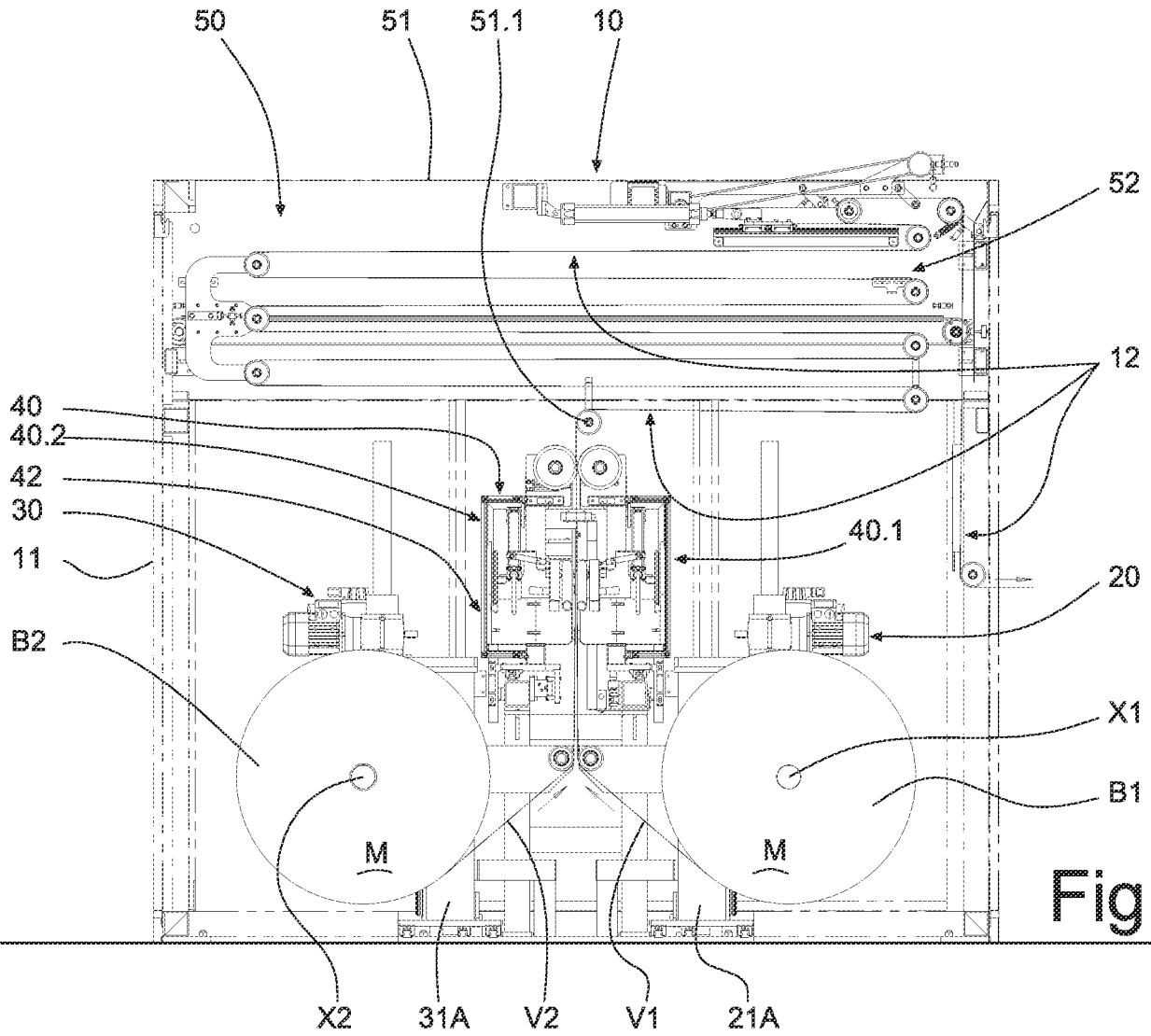
FIG. 2 represents a schematic side view of an unwinder according to the invention.

The unwinder 10 comprises a frame 11, fixed to the ground, which defines a working zone, called unwinding zone A, inside which a first roll-holder assembly 20 and a second roll-holder assembly 30 are present to allow an automatic roll switch. In the unwinder only one roll-holder assembly is operating at a time, while the other assembly remains equipped with (or standing by to receive) a new roll to carry out the automatic roll switch. FIG. 2 shows the unwinder 10, in which an unwinding roll B1 is in the first roll-holder assembly 20 and a second spare roll B2 is loaded in the second roll-holder assembly 30. FIG. 1 instead shows the unwinding roll B1 in the first roll-holder assembly 20, while the second roll-holder assembly 30 is standing by to receive the spare roll B2, as will be better explained below.

In the unwinding zone A, the two roll-holder assemblies 20 and 30 are facing each other, so that the respective unwinding axes X1 and X2 of the two rolls B1 and B2 are parallel to each other.

In the unwinding zone A, between the two roll-holder assemblies 20 and 30, in a position at least partly above the height of the unwinding axes of the rolls B1-B2, a splicing assembly 40 is present, which allows splicing of the ply V1 of the roll B1 being unwound from the roll-holder assembly to the ply V2 of the spare roll B2 arranged on the other roll-holder assembly.

Above the splicing assembly 40 and the roll-holder assemblies 20-30 in the unwinding zone A is an accumulation unit 50 of the ply being unwound, so that during the roll switching step, i.e., when the unwinding roll is about to run out and unwinding must be stopped to allow the trailing edge of the ply of the unwinding roll to be cut and spliced to the leading edge of the spare roll, the amount of ply exiting from the unwinder is sufficient to feed the rest of the plant without machine downtime.

In practice, an unwinding path 12 is defined in the unwinder 10 for the ply of the unwinding roll (according to a direction of feeding of the ply, also called machine direction MD), which starts from the roll-holder assembly with the unwinding roll, passes in succession through the splicing assembly 40, the accumulation unit 50, to the outlet of the device 10. It is clear that this path 12 is substantially always the same from the splicing assembly 40 to the outlet of the device 10, while it has a different initial section from the roll-holder assembly to the splicing assembly 40 depending on whether the unwinding roll is on the first roll-holder assembly 20 or on the second roll-holder assembly 30.

The two roll-holder assemblies 20 and 30 are substantially the same as each other. Hereinafter only the structure of the second roll-holder assembly 30 will be described, the structure of the first assembly being substantially identical. Hereinafter and in the figures, the components of the second roll-holder assembly will be numbered from 31 to 39, while the components of the first roll-holder assembly will be numbered from 21 to 29 (identical components will have the same number in the tens).

Figure 6:
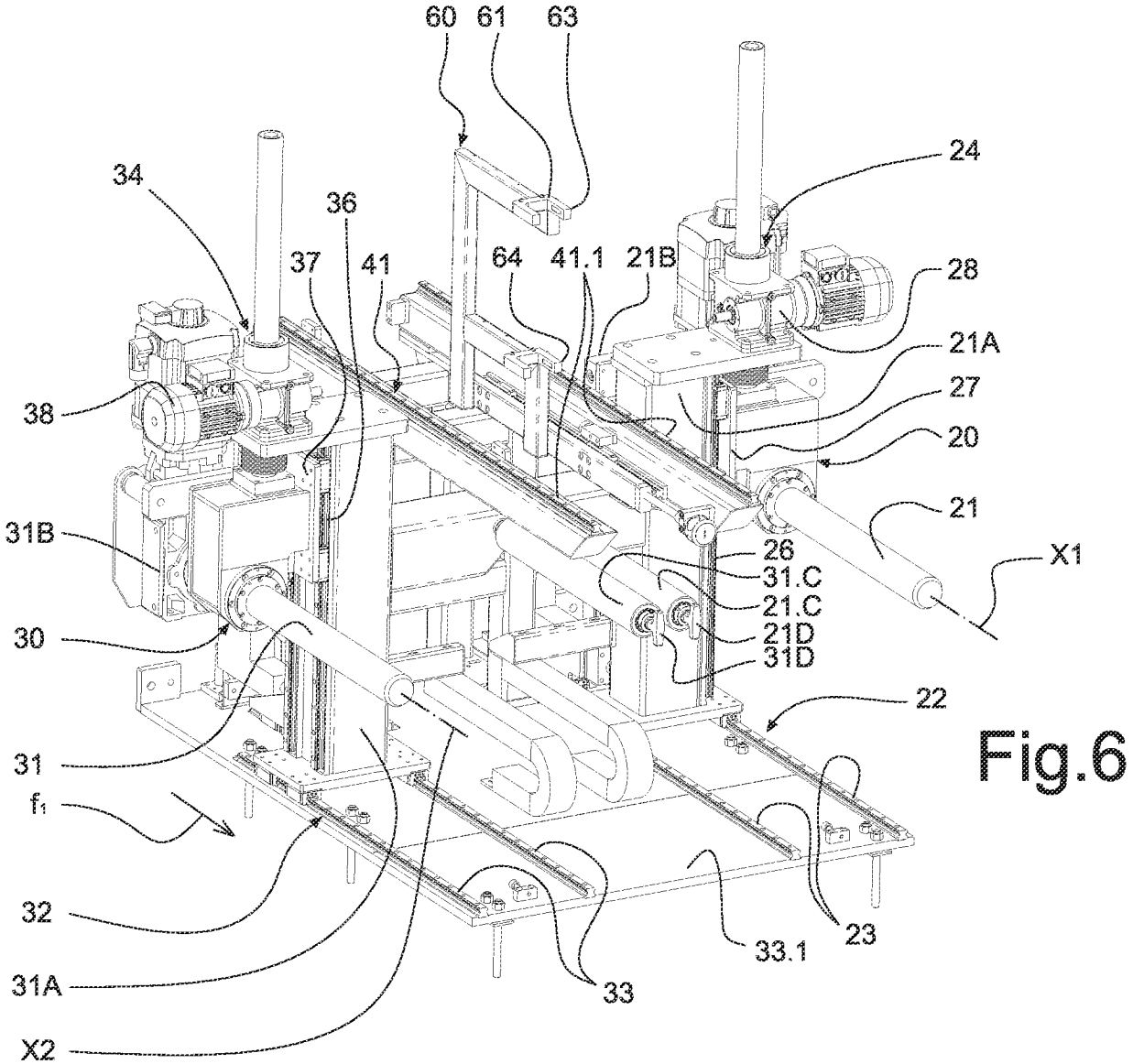
FIGS. 6 and 7 represent axonometric views of the roll-holder assemblies of the unwinder of the preceding figures, shown from two opposite points of view.
Figure 7:
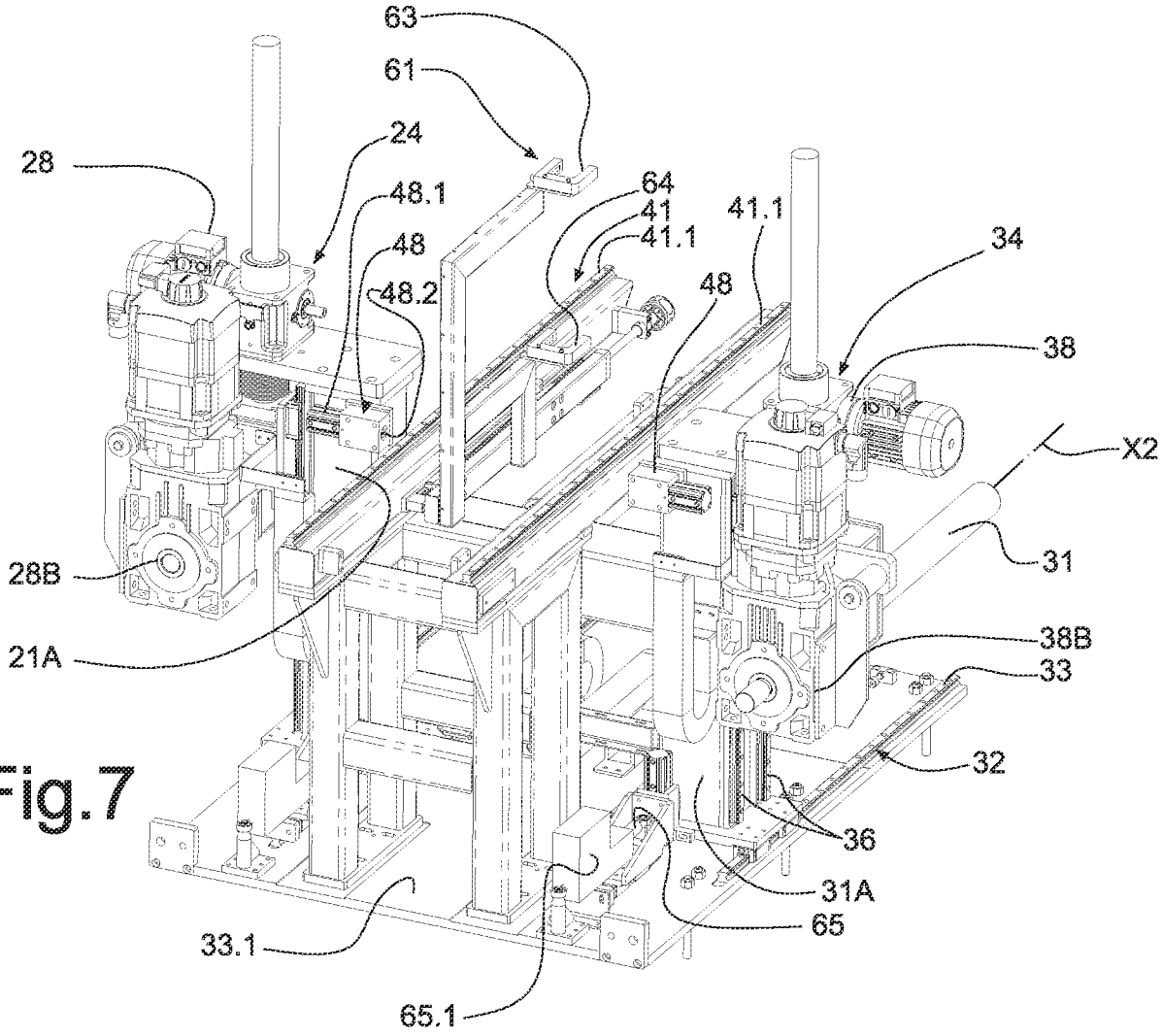

With particular reference to FIGS. 6 and 7, the second roll-holder assembly 30 comprises an unwinding rod 31, adapted to be inserted into the hollow core of the roll to be unwound whose axis corresponds to the unwinding axis X2 of the roll. This unwinding rod 31 is provided projecting from a support frame 31A, for example in form of a support turret. An electric motor 31B is associated with the unwinding rod 31 to allow rotation of the rod and therefore of the roll supported thereon.

A first deviator roller 31C for the ply to be unwound from the roll also projects from the support frame 31A, parallel to the unwinding rod 31.

Advantageously, the roll-holder assembly 30 also comprises a system for the lateral movement 32 of the unwinding rod 31, adapted to allow the movement of this rod 31 from the unwinding zone A (i.e., the unwinding position of the roll) to a zone H (also defined loading zone of the roll) outside the first unwinding zone (see for example also FIG. 4 and FIG. 8), so as to facilitate loading of the roll on the unwinding rod 31 by an operator. Zone outside the unwinding zone A is meant, for example, as a zone axially lateral to a vertical plane on which the outermost circular base M of the roll lies.

In this example, this lateral movement system 32 provides for an axial translation of the unwinding rod 31 (i.e., parallel to the unwinding axis of the roll, i.e. transversal to the path of the ply, i.e. to the direction of feeding of the ply MD), from the position in the unwinding zone A to a position axially outside the unwinding zone (i.e., the loading zone), and vice versa.

More in particular, in this configuration, the lateral movement system 32 comprises, for example, a first guide 33 (for example formed of a track) for the support turret 31A carrying the unwinding rod 31, parallel to the axis X2 of the rod.

This first guide 33 is, for example, on a platform 33.1 fixed to the ground, and facilitates horizontal sliding of the turret 31A with rod 31.

In practice, the turret 31A with unwinding rod 31 forms a single unit with a trolley that allows the transversal movement (arrow f1 in FIGS. 6 and 8) of the turret/rod and therefore of the roll to move this latter from the loading zone X (i.e. from a zone in which the roll loaded on the unwinding rod has a circular base M facing the unwinding zone A) outside the unwinding zone A, to the unwinding zone of the roll, thus facilitating the loading operation.

Preferably, the extraction movement of the roll-holder assembly 32 is of manual type, i.e., it is the operator who pulls or pushes the roll-holder assembly 32 from the unwinding zone A to the loading zone H and vice versa. For example, to help the operator, a first handle 31D is provided on the top of the first deviator roller 31C (indicated in FIG. 6). In other embodiments, a pneumatic piston can be provided, with the purpose of relieving a manual movement of the support turret/cylinder along this guide, in the manner of a gas spring. In other embodiments, an automatic movement device can be provided in the form of a pneumatic, hydraulic or electromechanical actuator that moves the roll-holder assembly autonomously.

Advantageously, the second roll-holder assembly 30 comprises a device 34 for the downward movement, and vice versa, of the unwinding rod 31, so as to enable the rod to be lowered to a distance from the ground such as to allow the roll to be loaded onto it and then enabling the rod with the loaded roll to be raised again to an unwinding height without particular efforts by the operator.

For example, this downward movement device 34 comprises a second downward translation guide 36 (for example in the form of a track), preferably a vertical guide, fixed to the support frame/turret 31A, and a slide 37 arranged slidingly on the second guide 36. The unwinding rod 31 is placed on said slide, preferably together with its motor 31B.

Advantageously, the movement device 34 comprises a first movement actuator 38, fixed to the support frame/turret 31A that interacts with the slide 37. For example, this first actuator 38 is of electromechanical type and is substantially an electric gear motor equipped at the output with a rotary lead screw that engages a worm gear associated with the slide 37. This first actuator 38 allows the vertical movement of the unwinding rod 31 with and without the roll.

Figure 8:
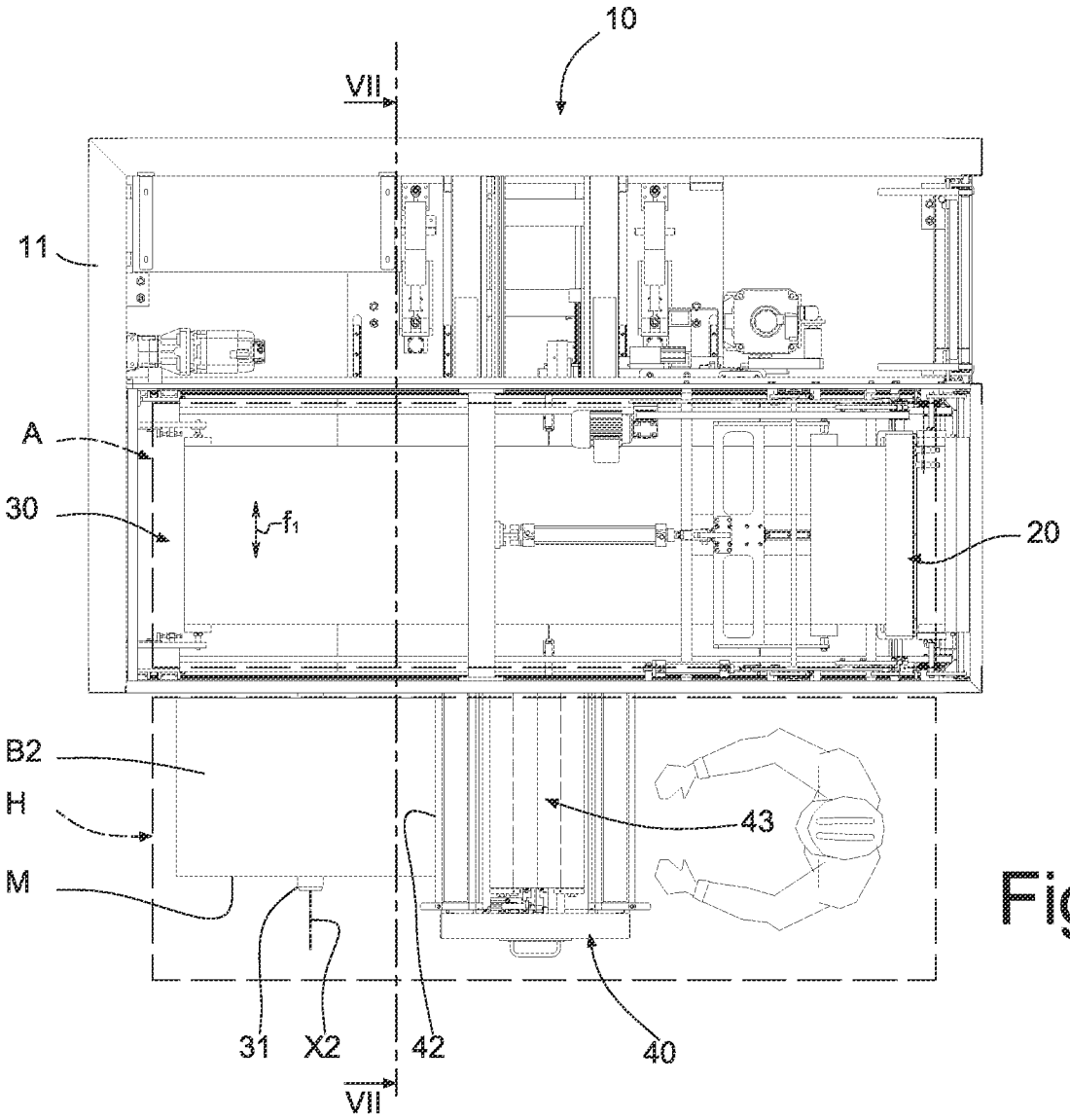
FIG. 8 represents a top view of the unwinder as in the preceding figures, during the step of preparation of the leading edge of the ply on the spare roll to be spliced, wherein the respective roll-holder assembly and the splicing assembly are extracted from the unwinding zone.
Figure 8A:
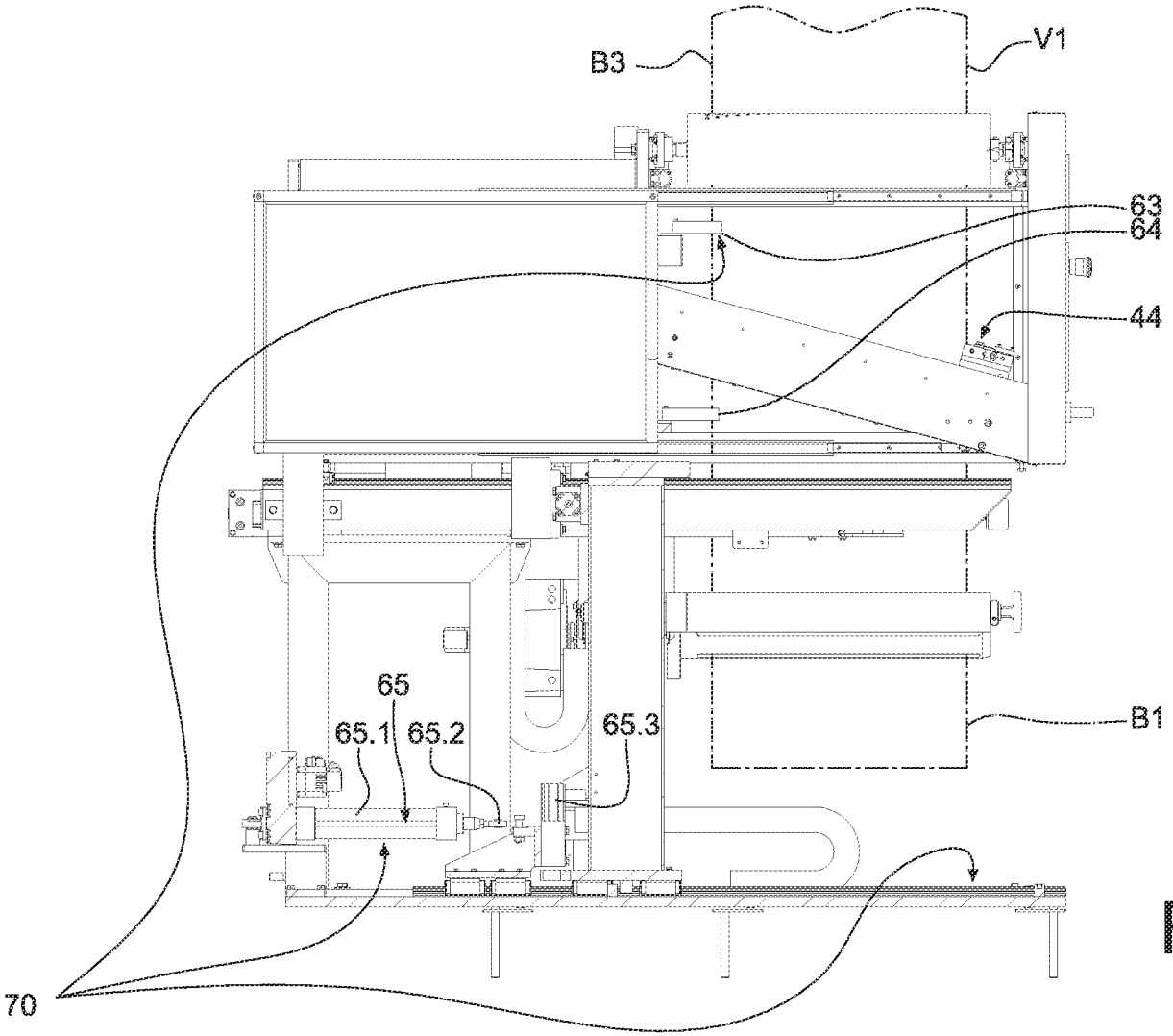
FIG. 8A represents a transverse view, sectioned along a line arranged like the line VIII-VIII of FIG. 8, of a portion of the unwinder as in the preceding figures, a portion showing a roll-holder assembly (without the roll) and the splicing assembly arranged inside the unwinding zone, not operational.

Advantageously, the unwinder 10 also comprises an automatic guide device 70 for the side edge B3 of the ply of the unwinding roll (indicated in FIG. 8A). This automatic guide device 70 comprises a first sensor 63 that detects the position (for example the position along a direction parallel to the unwinding axis X1) or the presence in this position of the edge B3 of the ply of the unwinding roll. For example, this sensor is fork shaped, through the concavity of which the edge of the ply is adapted to pass and is able to provide an electrical signal proportional to the length of product inside it. For example, the lower side of the fork is provided with a sensor element, such as an ultrasonic (or optical or infrared) transmitter, which emits short acoustic pulses cyclically. These are detected by the ultrasonic receiver arranged in the upper side of the fork. When the ply occupies the space in the fork it covers this sound path and dampens the receiving signal based on the coverage. Based on the level of coverage, a signal is emitted, for example to control a device for changing the position of the edge, as explained below. For example, a sensor of this type is commercially known with the name "bks+" by the German company Microsonic GmbH. It is clear that other types of sensors can be used, for example an optoelectronic device, a photocell, a mechanical system, a microswitch device, etc.

The first sensor 63 is associated with a pre-determined optimal position of the edge of the ply during unwinding. If, during this unwinding, the first sensor 63 detects a position of the edge of the ply not conforming to the optimal position (naturally associated with a tolerance range), the electronic system of the unwinder orders the device for changing the axial position of the unwinding rod to move the rod with a direction and to an extent such as to return the side edge B3 to the optimal position. For example, the device for changing the axial position of the unwinding rod comprises a system for moving the rod that coincides, for example, with the lateral movement system 22 described above, to allow translation in transversal direction, i.e., parallel to the axis X1, of the roll-holder assembly 20 with the unwinding roll, in combination with an automatic movement device 65, such as a second actuator 65.1, preferably of electromechanical type of the type comprising a motor equipped with worm gear that interacts with a lead screw, for example (see in particular FIG. 8A) fixed to the frame 11 and equipped with an operating end 65.2 acting on the support frame of the roll-holder assembly. This fixing end 65.2 can be constrained to or released from the support frame of the roll-holder assembly, being equipped, for example, with a slot in which a pin translating vertically by means of an actuator 65.3, for example of pneumatic type, is adapted to be inserted.

Figure 4:
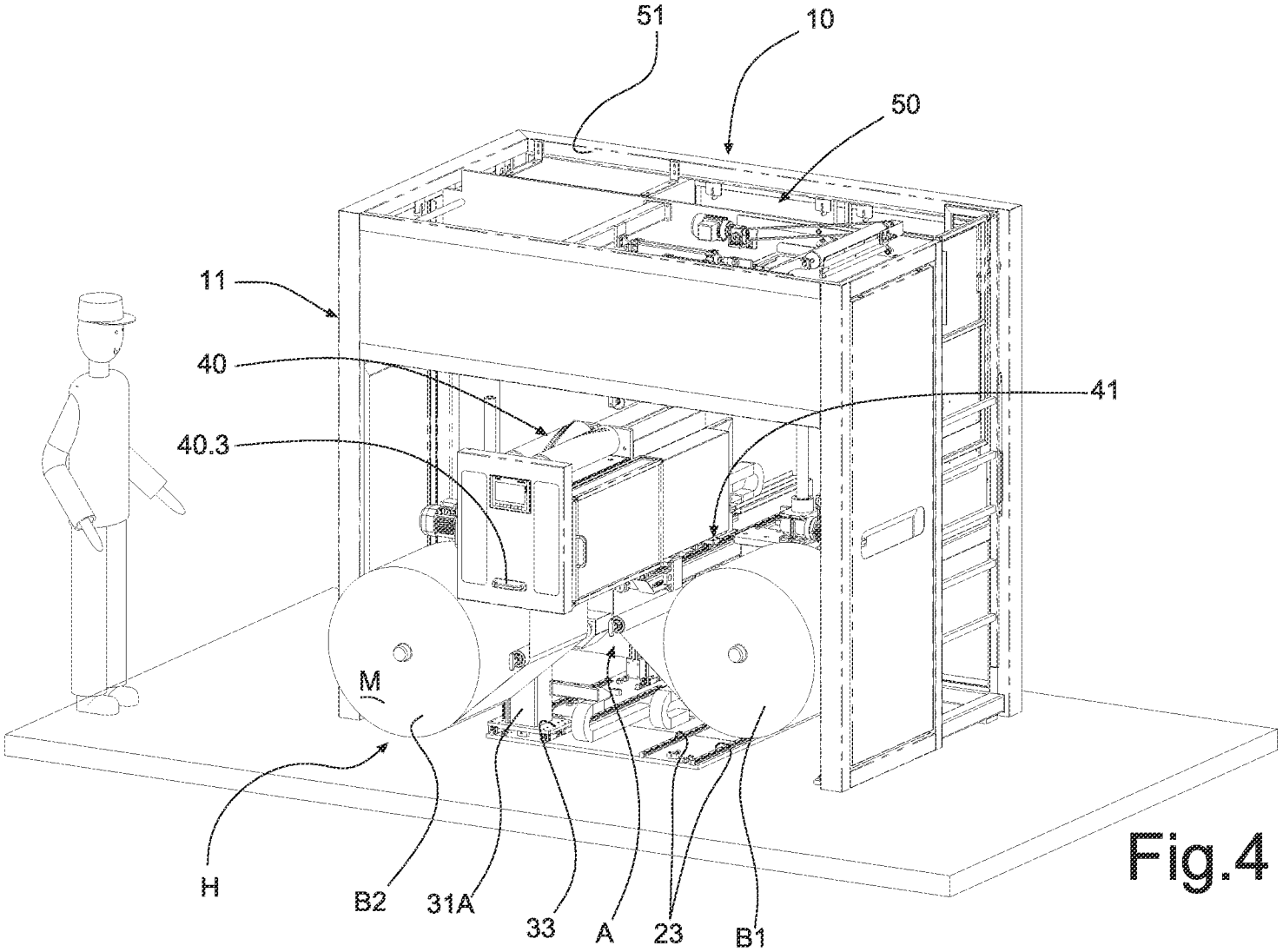

The splicing assembly 40 can advantageously be moved from a first working position above the two roll-holder assemblies in the unwinding zone A, to a second working position above an extracted roll assembly in the loading zone H (this extracted position is shown in FIGS. 4 and 8), to allow preparation for splicing of the leading edge of the ply wound on a roll, and in particular cutting of the leading edge of the ply and application of a first adhesive tape for splicing to this leading edge, which will then be spliced to the trailing edge of the ply being unwound, whose roll is about to run out, as better explained below. After being extracted, the splicing assembly 40 is connected stably to the extracted roll-holder assembly, as better explained below. After the leading edge has been prepared, the extracted roll-holder assembly and the splicing assembly 40 are returned to the unwinding zone, so that the two roll-holder assemblies 20-30 are facing and the splicing assembly 40 arranged above both.

Therefore, the splicing assembly 40 comprises an apparatus 41 for moving the assembly from the first working position to the second working position extracted from the working zone. This moving apparatus 41 comprises, for example, third sliding guides 41.1 (which extend projecting from a support behind the unwinding zone A) to allow the extraction movement, and support the splicing assembly between its two working positions.

The splicing assembly 40 comprises in this example a support structure 42 for the components of the assembly, arranged slidingly on the third guides 41.1, which extend projecting from the frame 11.

In the support structure 42, a nip 43 is defined between the components of the assembly 40 for the passage in downward direction of the leading edge of the ply wound on the spare roll (or the new roll) and for the ply of the unwinding roll. Advantageously, this nip, in addition to offering a downward passage, is open in the direction of the unwinding zone, to allow the entry/exit of the ply on the unwinding roll from said nip during the transversal movement of the splicing assembly.

In practice, the nip 43 divides, in this example, the splicing assembly 40 into two parts 40.1 and 40.2, one part relating mainly to splicing the leading edge of the ply on the spare roll when present in said first roll-holder assembly 20, and one part relating mainly to splicing the leading edge of the ply on the spare roll when present in said second roll-holder assembly 30.

For each of the two parts (see in particular FIG. 9), the splicing assembly 40 also comprises a device 44 for cutting the leading edge of the ply wound on the new roll, and a contrasting device 45 for holding the ply against a contrasting wall 46 positioned within the nip 43 (in other embodiments a single cutting device can be present for both parts). The cutting device 44 can also have a contrasting portion against the contrasting wall 46. For example, the cutting device 44 comprises a blade sliding on a suitable guide in transversal direction with respect to the feeding direction of the ply of the roll. The direction of cutting is preferably oblique to and inclined with respect to the direction of the width of the ply.

Advantageously, the splicing assembly 40 also comprises a pair of controlled adhesion surfaces 47 placed on opposing sides of the path of movement of the ply 12 and above the nip 43 (above the splicing zone of the plies), so as to allow, upon activation of the adhesion function, adhesion of a second adhesive tape, as better explained below.

In this example, these adhesion surfaces are aspirating surfaces, i.e., they have holes connected to an aspiration system (holes and system not shown in the figures). More in particular, in this example, these surfaces are the outer surfaces of aspirating rollers (hereinafter also indicated with the same number 47 associated with the generic adhesion surfaces).

Means for moving the aspirating surfaces (each surface preferably independently from the other) towards the path of movement 12 are provided, so as to cause the surfaces, i.e., the aspirating rollers, to interact with the ply being unwound. For example, these means can comprise guides for the translation of the rollers and actuators for their movement and are schematized by the movement arrow f47.

As mentioned above, the splicing assembly 40 is also equipped with an apparatus 48 for blocking the splicing assembly to the extracted roll-holder assembly, which comprises, for example (see FIG. 7), a pin/blocking seat system. For example, an actuator (for example pneumatic) 48.2 is fixed to the roll-holder assembly to allow the controlled translation (in transversal direction) of a pin 48.1 inside a corresponding seat (not visible in the figures) defined in the splicing assembly 40. As there are two roll-holder assemblies, which are extractable in turn, two blocking pins are preferably associated with the splicing assembly, for the respective seats of the two roll-holder assemblies. As will be more apparent below, the relative blocking between extracted roll-holder assembly and splicing assembly 40 remains active even when the roll-holder assembly is returned to the unwinding zone to carry out an automatic roll switch. Blocking will be deactivated, for example, when a new roll switching operation is required.

Advantageously, the unwinder 10 comprises a device 60 for aligning a side edge B2 of the leading edge of the ply on the spare roll with a corresponding side edge of the ply on the unwinding roll when both rolls are in the unwinding zone A.

Advantageously this alignment device 60 comprises a device 61 for verifying the alignment of the aforesaid edges B2 and B3 of the spare roll and the unwinding roll and a device 62 for correcting any misalignment detected.

For example, the edge alignment verification device 61 comprises the aforesaid first sensor 63 that detects the position (for example the position along a direction parallel to the unwinding axis X) or the presence in this position of the edge B3 of the ply of the unwinding roll.

This edge alignment verification device 61 also comprises a second sensor 64 that detects the position (for example, the position along a direction parallel to the unwinding axis X2) or the presence in a certain position of the edge B2 of the leading edge of the spare roll which has to be spliced. For example, this sensor is fork shaped, through the concavity of which the edge of the ply is adapted to pass and is able to provide an electrical signal proportional to the length of product inside it. For example, the lower side of the fork is provided with a sensor element, such as an ultrasonic (or optical or infrared) transmitter, which emits short acoustic pulses cyclically. These are detected by the ultrasonic receiver arranged in the upper side of the fork. When the ply occupies the space in the fork it covers this sound path and dampens the receiving signal based on the coverage. Based on the level of coverage a signal is emitted, for example to control a device for changing the position of the edge, as explained below. For example, a sensor of this type is commercially known with the name "bks+" by the German company Microsonic GmbH. It is clear that other types of sensors can be used, for example an optoelectronic device, a photocell, a mechanical system, a microswitch device, etc.

In this example, a single second sensor 64 is provided, which detects the position (for example the position along a direction parallel to the unwinding axis X) or the presence in a certain position of the edge B2 of the leading edge of the spare roll, whether it is carried by the first roll-holder assembly 20, or whether it is supported by the second roll-holder assembly 30. In other embodiments, two seconds sensors could, for example, be present, one for each roll-holder assembly.

The two sensors 63 and 64 are operationally connected to the electronic unwinder control system and when the system verifies that the two edges B2 and B3 are not in the same position, i.e. they are not aligned, it orders the misalignment correction device 62 to change the position of one of the two edges and more advantageously, to change the position of the leading edge of the ply on the spare roll which is to be spliced to the ply on the unwinding roll (which is about to run out).

In this example, the misalignment correction device 62 comprises a system for moving the spare roll in the direction of correction. For example, this system corresponds to the device for changing the axial position of the unwinding rod provided for the guide device of the edge of the unwinding roll, but referred to the spare roll-holder assembly, and therefore acts as system for moving the unwinding rod 31 of the spare roll in axial direction by the amount equivalent to the misalignment measurement. Therefore, this system for moving the rod in this example comprises the system for the lateral movement 32 described above, to allow translation in the transversal direction, i.e., parallel to the axis X2, of the roll-holder assembly 30 with the spare roll, in combination with the automatic movement device 65, comprising the secondo actuator fixed to the frame 11 and acting on the support frame 31A of the roll-holder assembly 32.

It is clear that a movement system will be provided for each roll-holder assembly in order to correct the positioning of the roll when this is a spare roll.

Therefore, an automatic movement device 65 is provided for each roll-holder assembly. When the automatic movement device 65 relates to the unwinding roll which must be switched, it is only active to carry out changes of the position of the first roll-holder assembly (the one with the unwinding roll) so as to maintain the side edge of the ply being unwound in the desired optimal position, as explained above in relation to the automatic guide device for the side edge of the ply of the unwinding roll. When this assembly is not active, the automatic movement device 65 holds the related roll-holder assembly of the unwinding roll blocked in position.

The accumulation unit 50 of the ply being unwound comprises a structural support assembly 51 placed above the roll-holder assemblies 20, 30 and the splicing assembly 40.

An initial deviator roller 51.1 for the ply being unwind, which directs the ply towards one end of the accumulation unit, is fixed to this assembly, approximately above the aspirating rollers of the splicing assembly 40.

The accumulation unit 50 is provided with a ply feed apparatus 52 downstream of the accumulation unit, which comprises a first series of deviator rollers 53.1, fixed with respect to the structural assembly 51, whose axes of rotation define a common first surface 53A (in this example the first surface 53A is a single plane, as the axes are substantially coplanar and vertically aligned; in other examples, these axes can be staggered and therefore this first surface is defined by a surface consisting of portions of plane inclined with respect to one another, in a zig-zag manner), and which are parallel to one another and transversal to the machine direction of the ply, i.e., parallel to the unwinding axis of the roll.

The feed apparatus 52 also comprises a second series of deviator rollers 54.1 placed on a movable trolley 54, whose axes of rotation define a common second surface 54A (in this example the second surface 54A is a single plane, as the axes are substantially coplanar and vertically aligned; in other examples, these axes can be staggered and therefore this second surface is defined by a surface consisting of portions of plane inclined respect to one another, in a zig-zag manner).

The movable trolley 54 is adapted to be moved (arrow f54) from a first maximum accumulation position, wherein the second series of rollers 54.1 is spaced from the first series of rollers 53.1, with the second surface 54A positioned on a first side of the first surface 53A (for example as shown in FIGS. 2, 11A, 12A, 12N), to a second position wherein the second series of rollers 54.1 is arranged close to the first series 53.1 (for example, as shown in FIGS. 12B-12M), with the second surface 54A positioned on the second side of the first surface opposite the first side, so that the feeding downstream of the accumulation unit is achieved by moving the trolley 54 from the first position towards the second position.

Figure 12A:
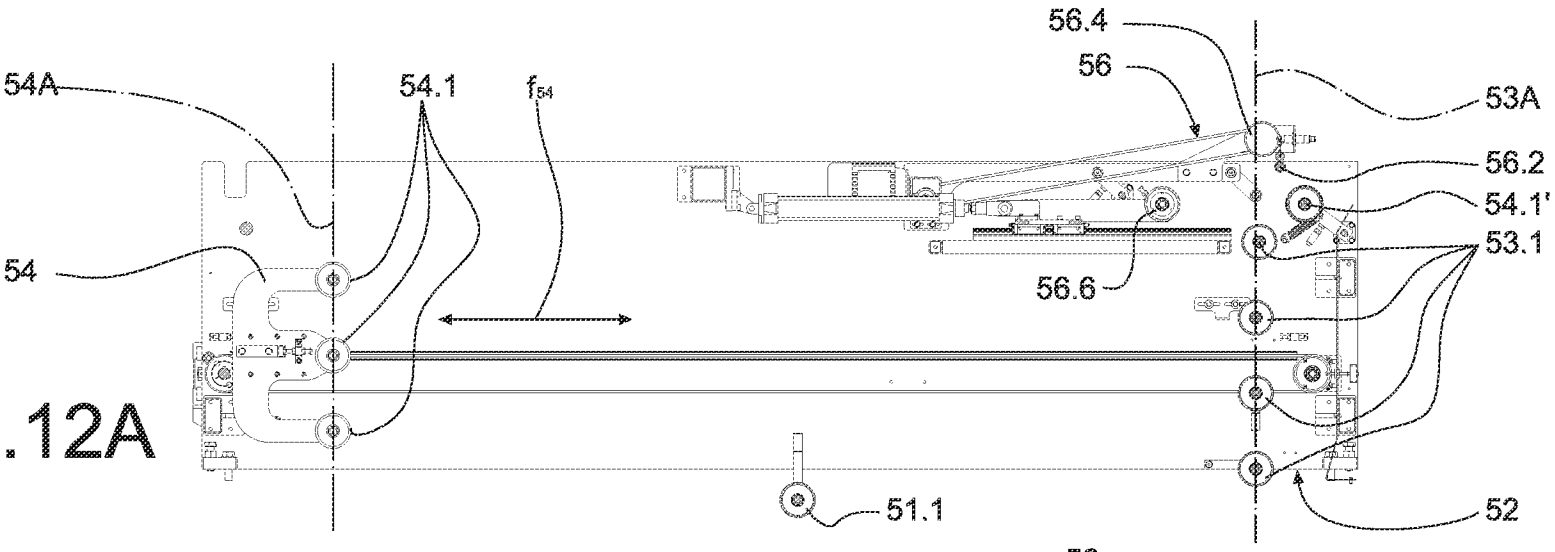
FIGS. 12A, 12B, 12C, 12D, 12E, 12F, 12G, 12H, 12I, 12L, 12M and 12N represent schematic side views of a sequence of operating steps of the accumulation unit of an unwinder according to the invention.
Figure 12B:
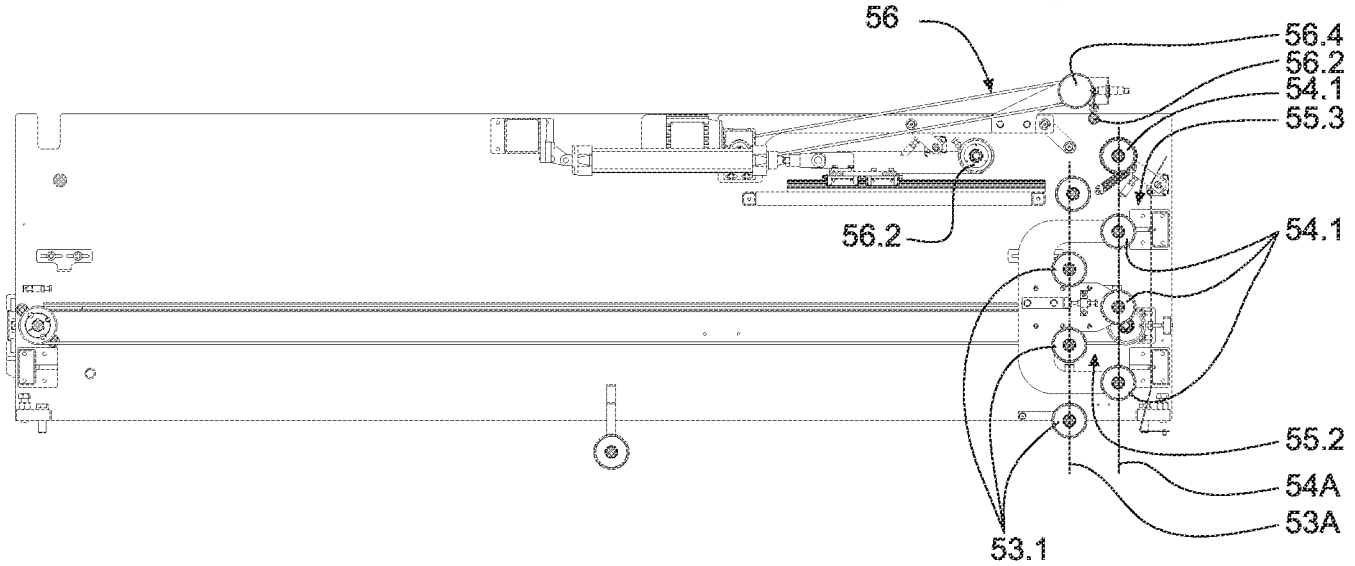
Figure 12C:
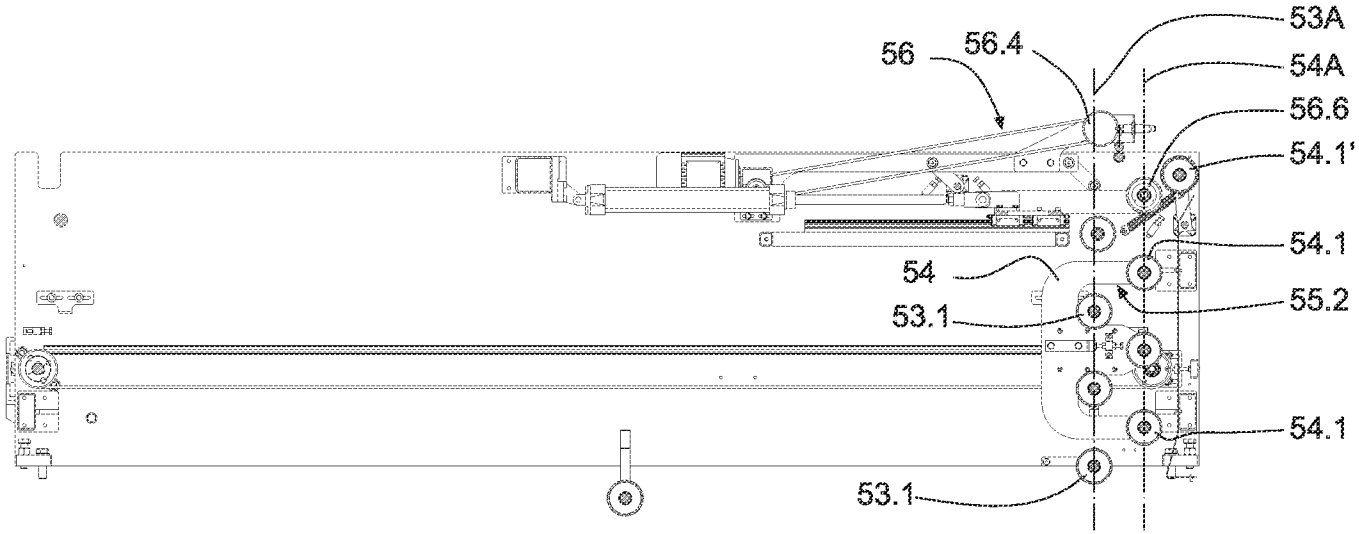
Figure 12D:
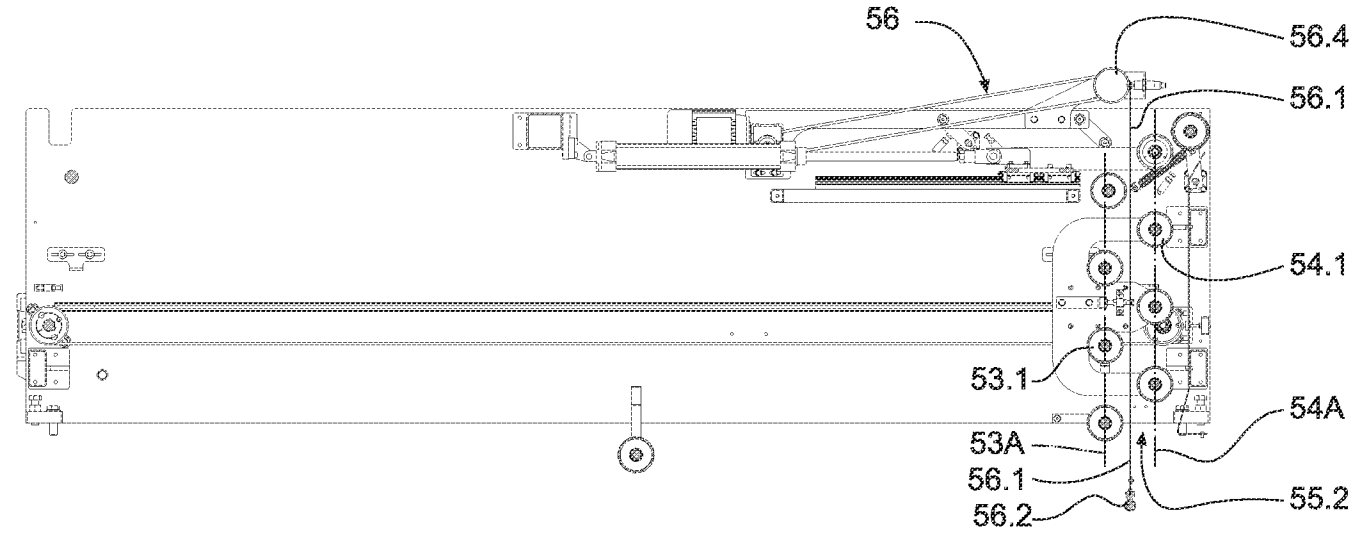
Figure 12E:
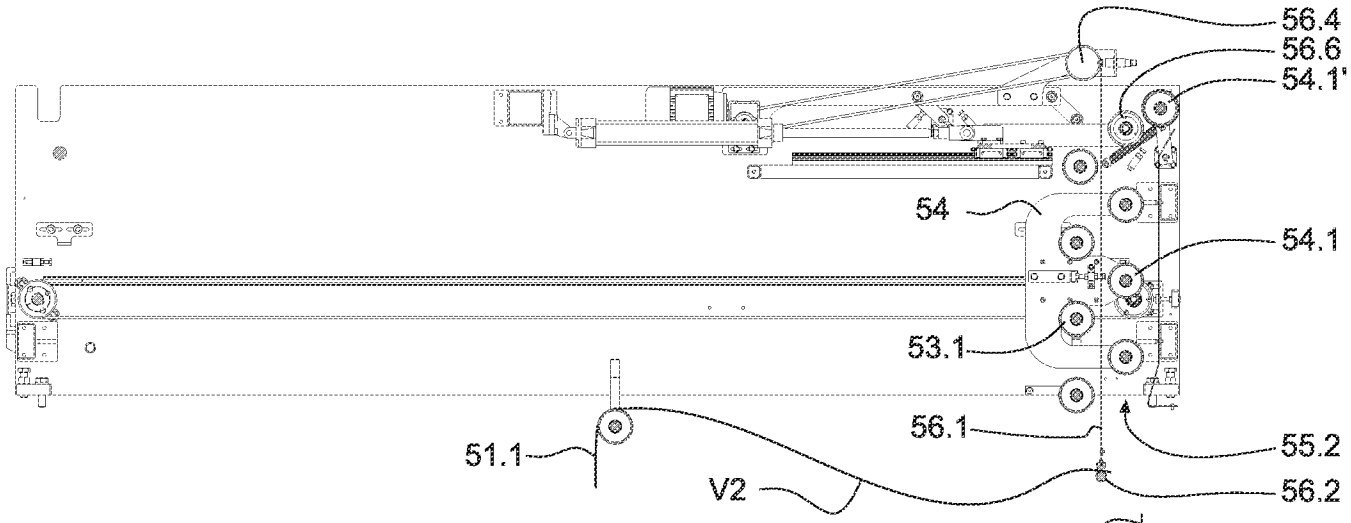
Figure 12F:
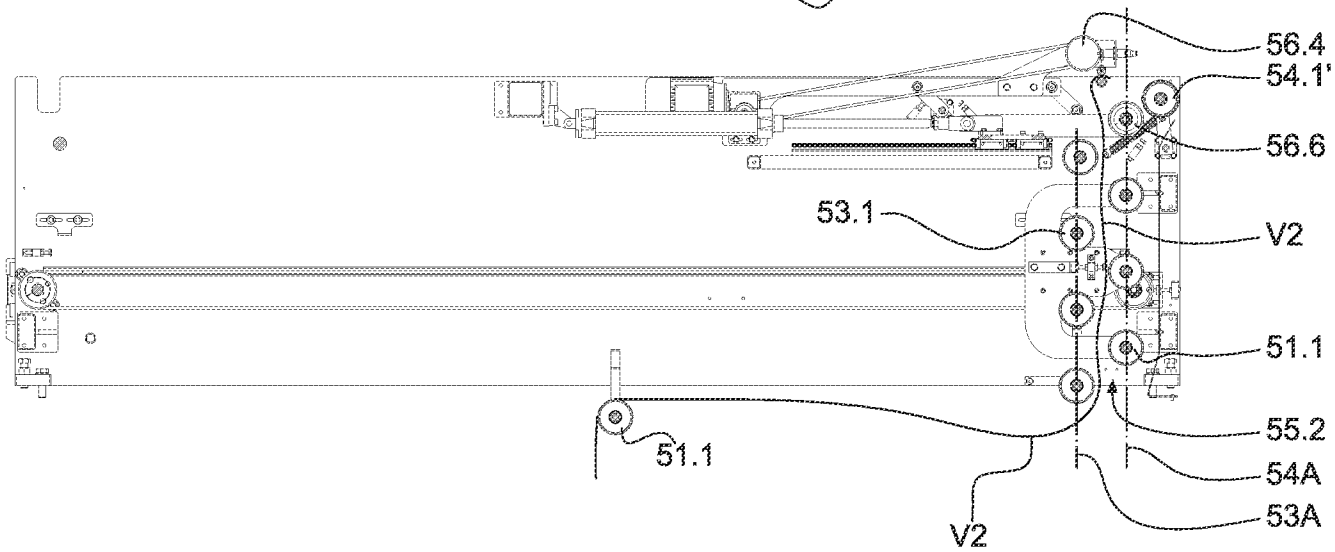
Figure 12G:
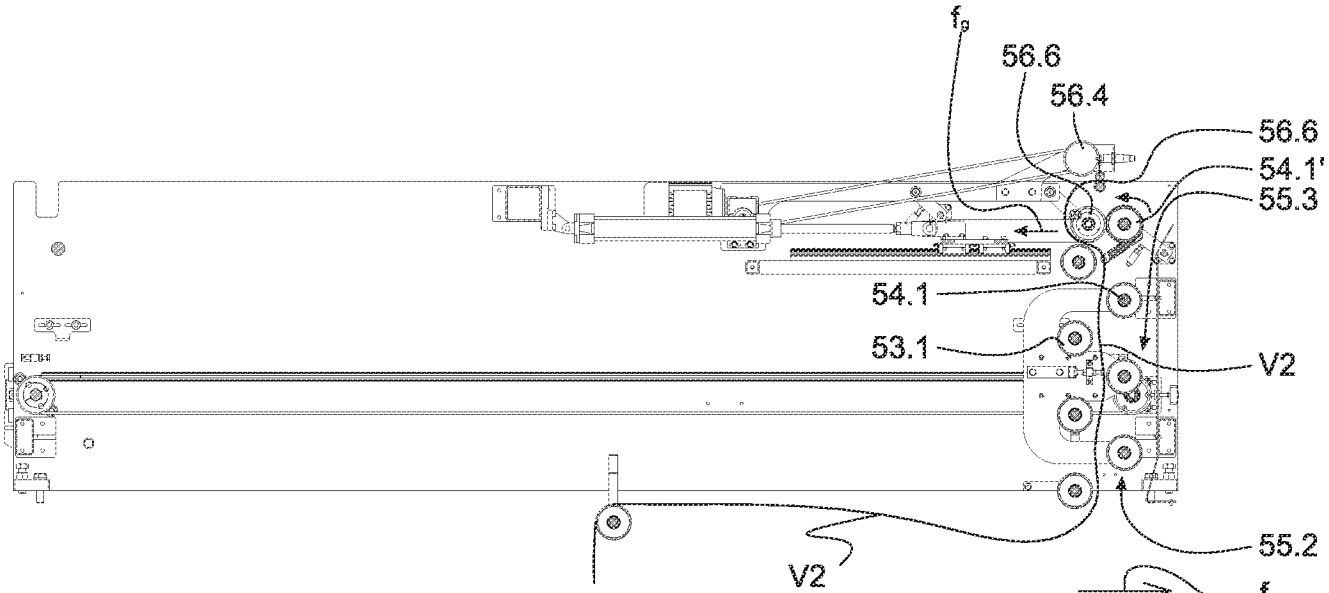
Figure 12H:
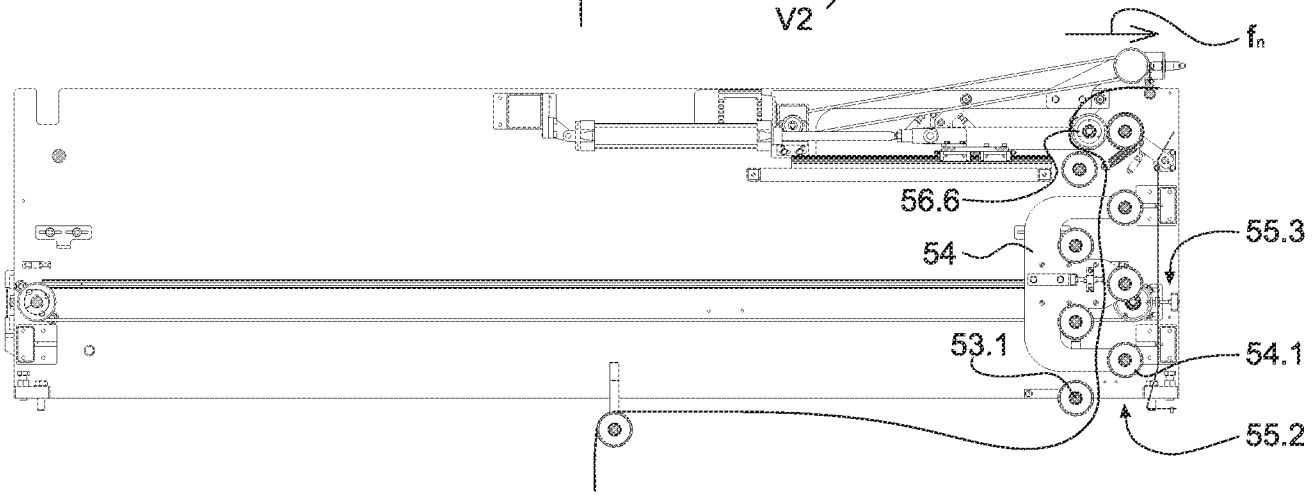
Figure 12I:
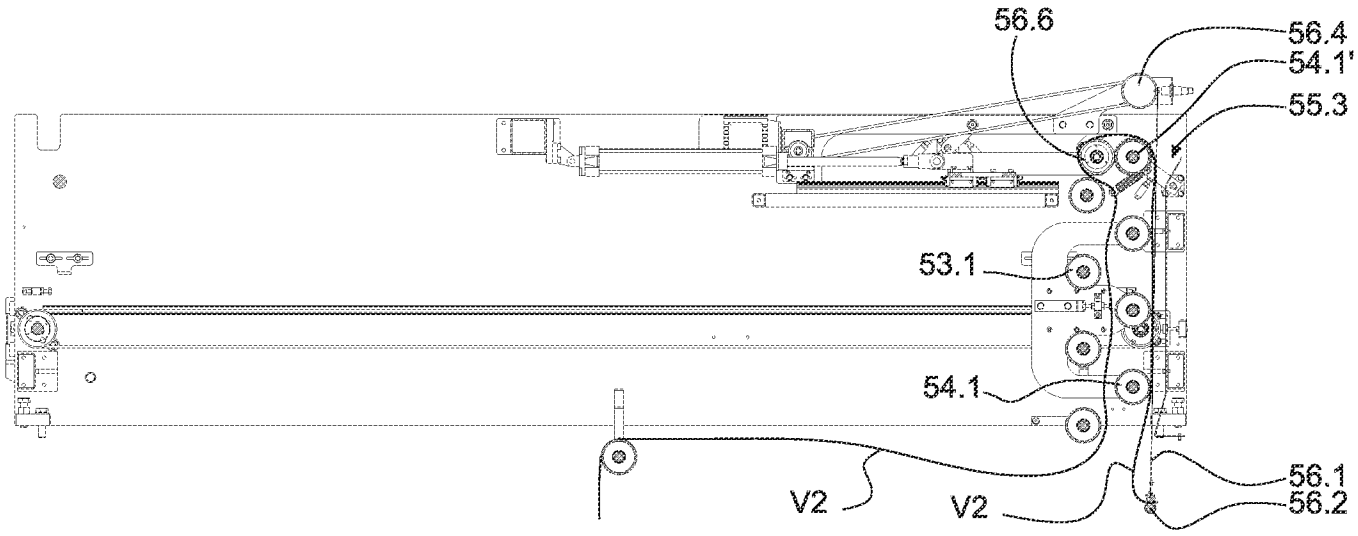
Figure 12L:
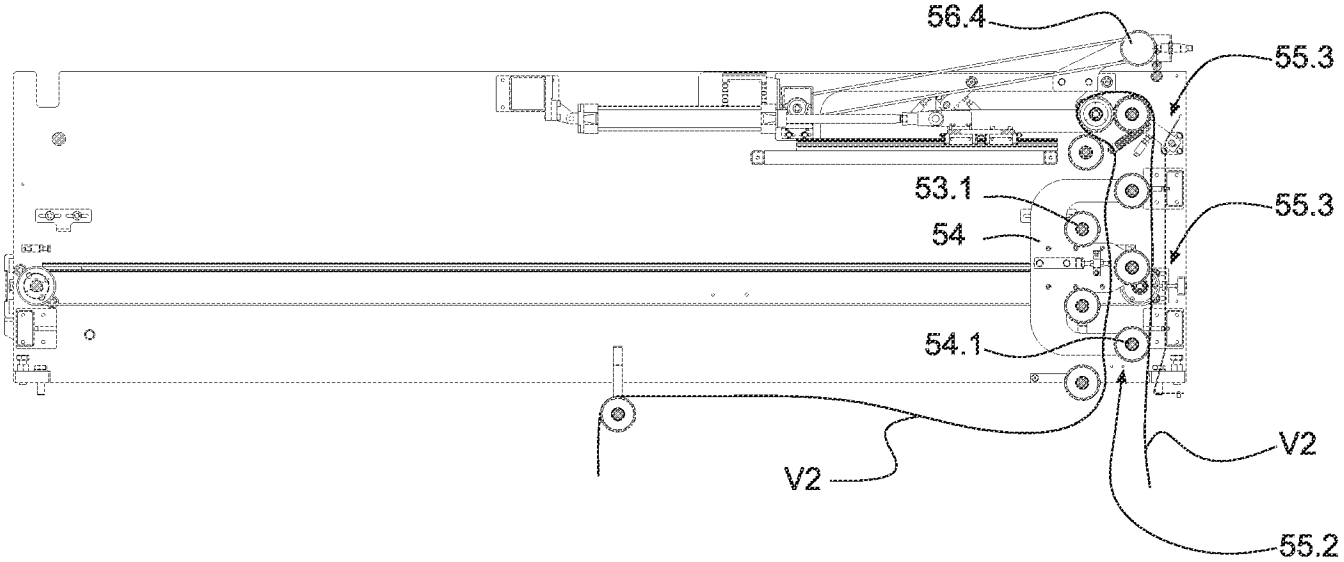
Figure 12M:
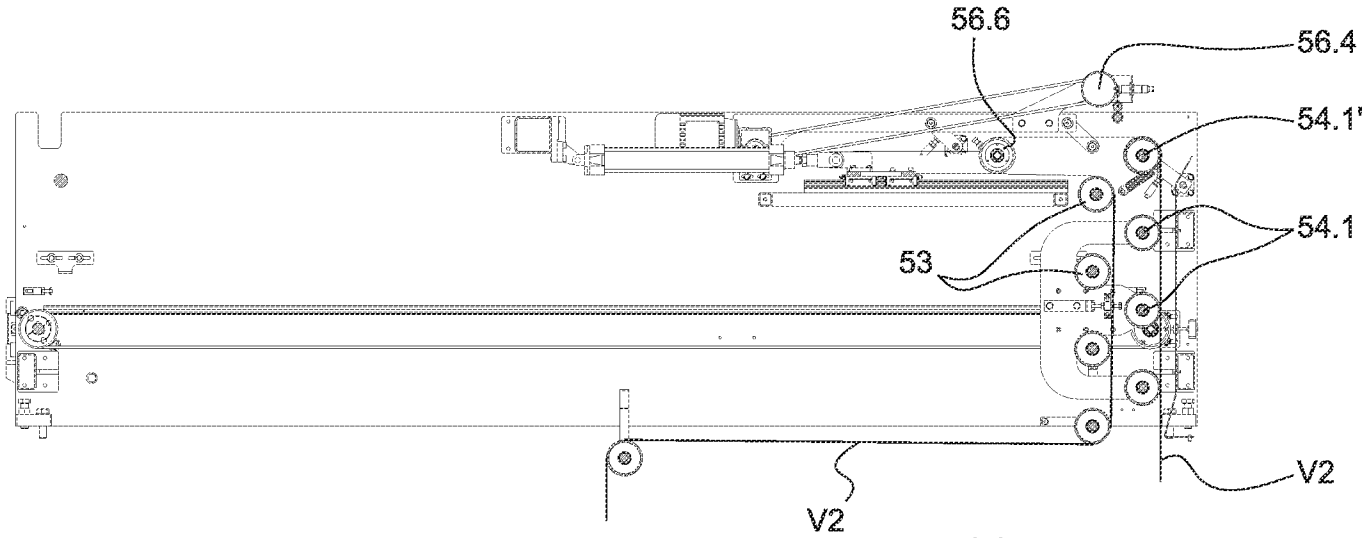
Figure 12N:
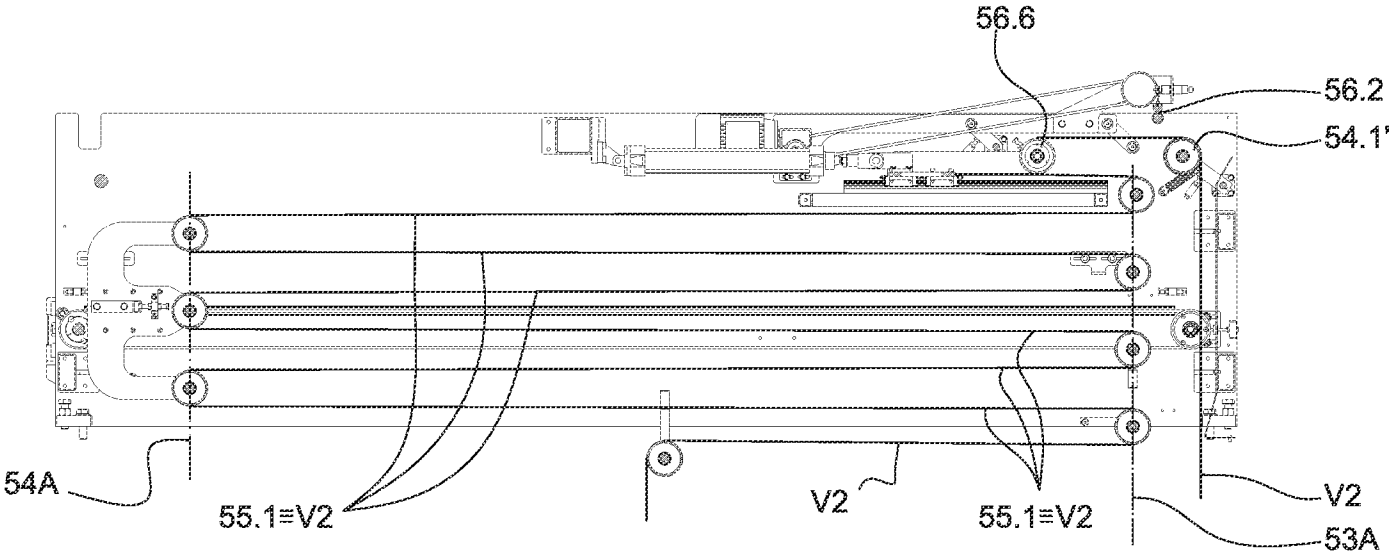

In practice, the accumulation unit 50 comprises an accumulation path of the ply V2 comprising a plurality of accumulation sections 55.1 (which formally coincide with the sections of the ply, as is clear in FIG. 12N) overlapping at least in part, which are comprised between the deviator rollers of the first and of the second series 53.1 and 54.1, so that the movement of the trolley 54 from the first to the second position causes a variation (i.e., a decrease) of the length of the accumulation sections 55 that forms the feed of the accumulation unit downstream thereof, during the roll switching step, as better explained below.

Advantageously, the accumulation unit 50 comprises a section 55.2 for the insertion of the leading edge of the ply to be accumulated between the first and second series of rollers 53.1 and 54.1 (i.e., between the first and second surface 53A and 54A) when the trolley 54 is in the aforesaid second position: once the leading edge of the ply has passed through the insertion section 55.2, the trolley is moved towards the first position, so that the second series of rollers 54.1 draws the ply towards the second position, producing the overlapping accumulation sections 55.1. In this example, the insertion section 55.2 is upward, and is preferably mainly vertical.

The accumulation unit 50 also comprises a section 55.3 for the extraction from the accumulation unit for the leading edge of the ply to be accumulated, which is defined on the side of the second surface 54A of the second series of rollers 54.1, when the trolley 54 is arranged in the second position, opposite the side of the second surface 54A facing the first surface 53A. In this example, this extraction section 55.3 is downwards, and is preferably mainly vertical. At the end of the extraction section is the outlet from the accumulation unit so that the ply is conveyed to the printing machinery 101.

To take the leading edge of the ply to be accumulated to the insertion section 55.2 and then to the extraction section 55.3, the accumulation unit 50 is provided with a device for the automated insertion 56 that comprises a flexible element 56.1 to one end of which is attached a gripper device 56.2 for the leading edge of the ply to be accumulated, and a device 56.3 for adjusting the distance of the gripper device 56.2 from a device 56.4 for the pick-up or release of the flexible element so as to consent the movement of the gripper device (and hence of the leading edge of the ply) along the insertion 55.2 and extraction 55.3 sections. For example, the flexible element is a belt wound on a winding cylinder (the pick-up and release device 56.4) associated with which is a rotation motor kinematically connected to the winding cylinder (the device for adjusting the distance 56.3), which allows the gripper device (for example a pair of jaws that can be blocked on the leading edge of the ply) to be raised along the insertion section 55.2 and to be lowered along the extraction section 55.3.

There is also a dandy roller 56.6, whose purpose is to ensure constant product tension during all the working steps of the machine. Advantageously, this dandy roller helps to obtain the automatic insertion of the ply. For example, within the architecture of the device for the automated insertion, the dandy roller 56.6 is positioned slidingly on the top part of the accumulation unit to be moved from a tension position of the ply to a feed-in position, in which its axis is on the first surface 53A, in the highest position. When the dandy roller 56.6 is in this feed-in position (as shown in FIGS. 12C-12F), it abuts against the auxiliary deviator roller 54.1' (this roller is in a higher position than the deviator rollers of the first series 53.1 but aligned with the second surface 54A), shifting it (overcoming the force of the opposing springs) to a position outside the first surface 53A (this roller is at the top of a rocker arm that allows it to oscillate between the two positions, on 54A and outside 54A). When the dandy roller 56.6 is not abutting against this auxiliary roller 54.1', the latter is held on the second surface 54A by springs.

Loading of a first roll B1 into the unwinder 10 can be achieved as follows.

The operator moves the roll B1 towards the first roll-holder assembly 20 and the operator acts to allow the system 22 for the lateral movement of the unwinding rod 21 to translate the unit formed by the support turret 21A with the rod 21 on the first guide 22 towards the loading zone H. The mechanical pin associated with the actuator 65.3 that connects the actuator 65.1 of the automatic movement device 65 of the adjustment system to the roll-holder assembly is disengaged, the operator manually translates the roll-holder assembly from the unwinding position towards the loading zone. The rod 21 is then lowered by the downward movement device 24 to facilitate its insertion into the core of the roll B1.

By operating in the opposite direction, the roll B1 is raised and returned to the unwinding zone A.

The operator takes the leading edge of the ply wound on a roll, passes it around the first deviator roller 21C and then passes it through the nip 43 of the splicing assembly 40 and then between the aspiration rollers 47 to the initial deviator roller 51.1 of the accumulation unit 50 and then from this to the inlet end of the accumulation unit at the insertion section 55.2. The accumulation unit is as shown in FIG. 12A.

Here, the trolley 54 is translated (on suitable guides produced on the structural assembly 51 and moved by a system with gear motor and toothed belts 54.2,) from the first position (all to the left as shown in FIG. 12A) to the second position (as shown in FIG. 12B), so that the insertion section 55.2 is created between the first and second series of rollers 53.1 and 54.1.

In the meantime, the dandy roller 56.6 (FIG. 12C) of the automated insertion device 56 moves the auxiliary deviator roller 54.1', until it is in the feed-in position at the end of the insertion section 55.2.

The pick-up and release device 56.4 lowers the belt 56.1 (FIG. 12D) with the gripper device 56.2 of the leading edge of the ply to the inlet of the insertion section 55.2, where the operator fixes the leading edge of the ply to this device (FIG. 12E).

The belt 56.1 with the gripper device 56.2 is then raised through the insertion section 55.2 (by operating the motor for the adjusting the distance associated with the winding cylinder of the belt 56.1) until a position sensor detects the correct position of the gripper device (close to the winding cylinder that forms the pick-up or release device), as shown in FIG. 12F.

The dandy roller 56.6 is moved in the direction towards the rear part of the accumulation unit (left part in the figures, arrow fg), thereby engaging the ply, as shown in FIG. 12G.

The winding cylinder 56.4 of the belt 56.1 is moved in the opposite direction to the dandy roller, until it is above the extraction section 55.3, and carrying with it the gripper device 56.2 with the leading edge of the ply, as shown in FIG. 12H.

The winding cylinder of the belt 56.1 then lowers the belt with the gripper device through the extraction section 55.3, to the outlet of the accumulation unit, as shown in FIG. 12I. Here the operator detaches the leading edge of the ply from the gripper device (which is returned above the extraction section 55.3, as shown in FIG. 12L). From here the operator draws the leading edge of the ply into the printing machinery 101.

At this point, the dandy roller 56.6 is moved further to the left, tensioning the ply, as shown in FIG. 12M.

Finally, the movable trolley 54 is returned to an intermediate position between the first position and the second so that the overlapping accumulation sections 55.1 are formed between the deviator rollers of the first series and of the second series. FIG. 12N shows the configuration of the accumulation unit with the trolley 45 returned to its first working position, with the maximum accumulation sections 55.1. This configuration is achieved shortly before activating the roll switching step to maximize accumulation of the ply.

The plant 100 is now ready to operate. The ply, for example a paper strip/web equipped with labels to be printed, is wound on the roll B1 which is unwound by the unwinder 10 and reaches the printing machinery 101, in which printing is carried out continuously. At the outlet from the machinery 101, the printed ply is wound in the winder 102.

Figure 3:
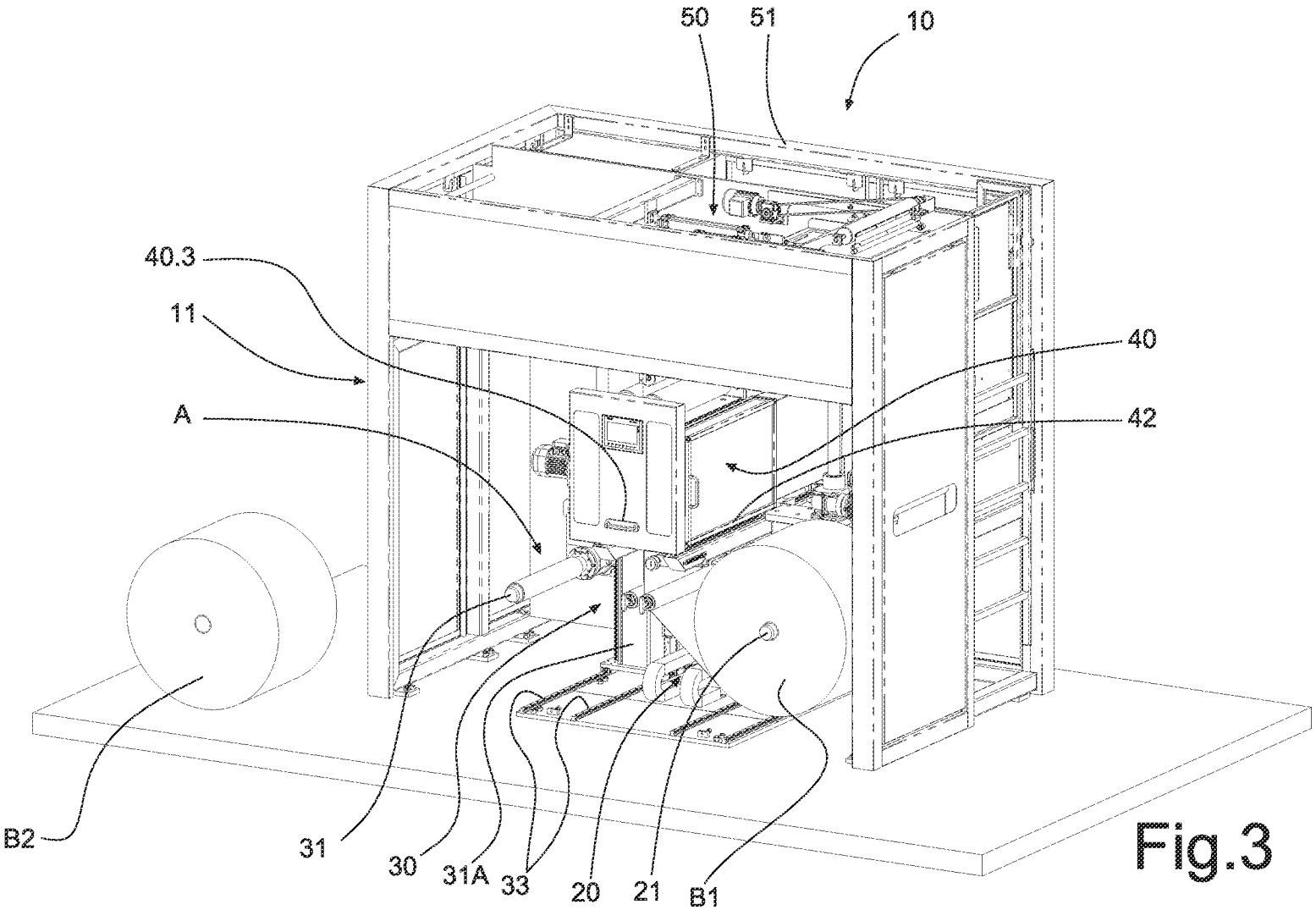
FIGS. 3, 4 and 5 show an axonometric view of the unwinder of FIG. 2, in a first step of loading a spare roll to carry out a roll switch, during the step of preparing the leading edge of the ply on the spare roll to be spliced and during a roll switching step, respectively.

Before the roll B1 runs out, the operator moves a spare roll B2 towards the unwinder 10 (FIG. 3).

In the same manner as for the roll B1, the operator moves the second roll-holder assembly 30 outside the unwinding zone A and loads the spare roll B2 onto it, raising it. Before returning the second roll-holder assembly with the spare roll to the unwinding zone A, the operator also extracts the splicing assembly 40 (FIG. 4) and fixes the roll-holder assembly 30 to the splicing assembly 40, forming a single unit.

The preparation for splicing is shown in particular in the FIG. 9. It must be noted that in these figures, the splicing assembly is shown from the opposite side with respect to FIG. 2 (and therefore also with respect to FIGS. 1, 3, 4, 5 and 8), so that the parts of the splicing assembly referring to the first roll-holder assembly 20 are on the left of the figure, while the parts referring to the second roll-holder assembly 30 are now on the right of the figure. In particular, the operator unwinds a certain amount of ply on the spare roll B2 and passes it around the first deviator roller 31C and inside the nip 43 of the splicing assembly 40 (in particular holding the ply between the contrasting wall 46 and the part of nip closest to the spare roll; in the FIGS. 9, the part to the right of the wall 46), to above the aspirating rollers 47, as shown in FIG. 9A.

Figure 9A:
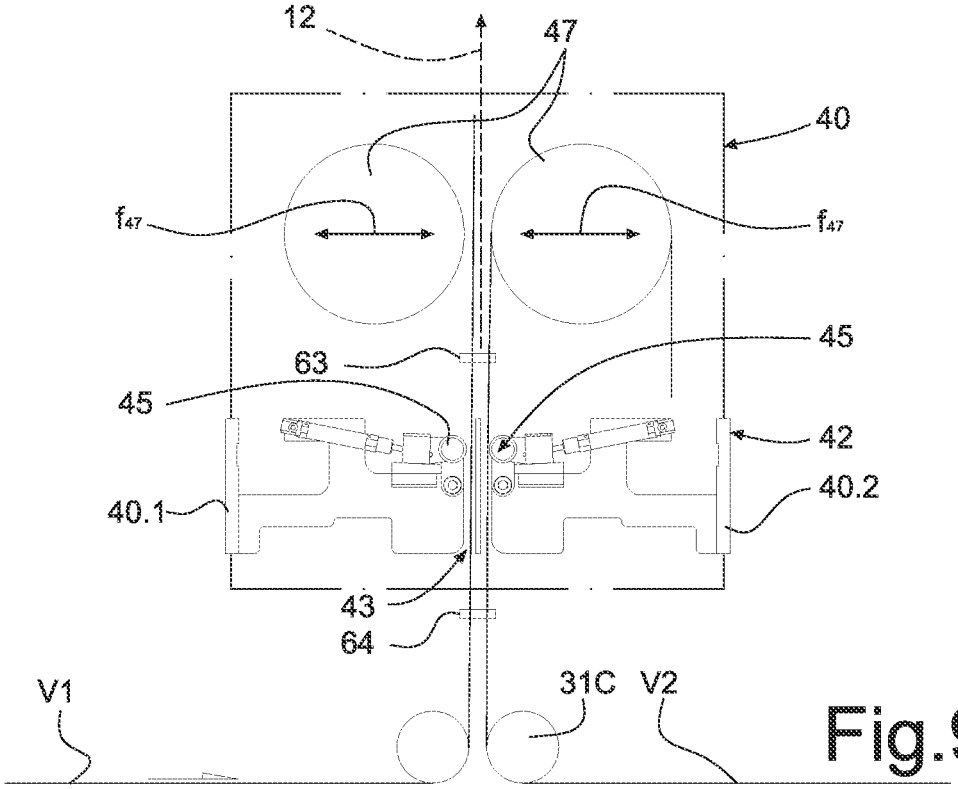
FIGS. 9A to 9H represent schematic side views of a sequence of operating steps of the splicing assembly shown schematically from the opposite side with respect to FIG. 2.
Figure 9B:
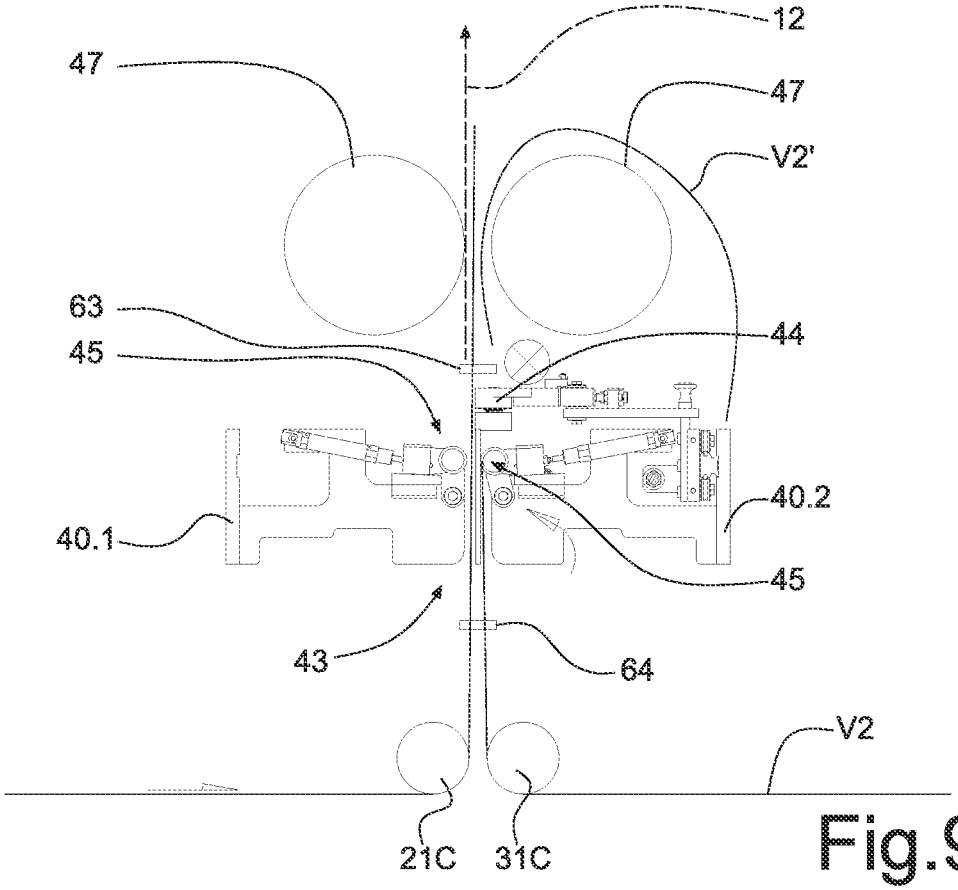
Figure 9C:
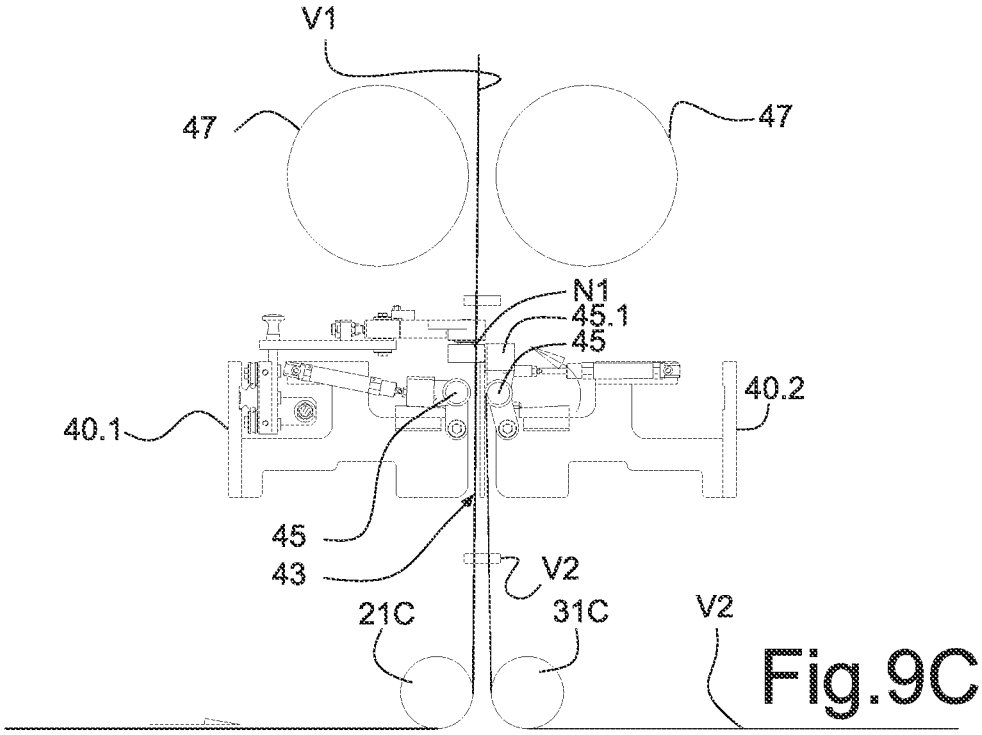
Figure 9D:
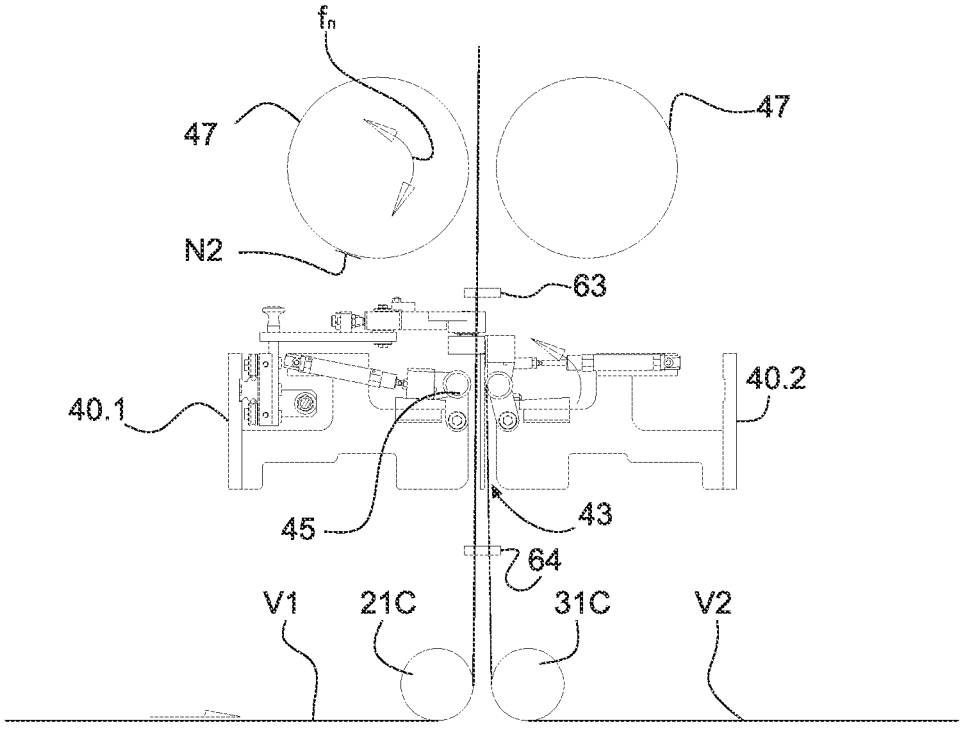

The operator centers the ply on the spare roll approximately in the center of the aspirating rollers 47, blocks the ply against the contrasting wall 46 thanks to the pad of the contrasting device 45 and operates the cutting device 44, trimming the leading edge of the ply, as shown in FIG. 9B. The operator then removes the trimmed ply V2' and applies the first adhesive tape N1 along the cut edge (FIG. 9C). Moreover, the operator also raises the splicing surface 45.1, which will function as contrast for the cutting wheel, allowing adhesion of the adhesive tape.

The operator activates aspiration of the aspirating roller 47 relating to the part of the splicing assembly occupied by the ply being unwound and makes a portion N2 of second adhesive tape adhere to it (the adhesive part of the second tape is facing the outside of the aspirating roller, the second adhesive tape N3 is held on the aspirating roller only by the vacuum pressure produced inside the roller). The operator rotates the aspirating roller 47 with the second adhesive tape N2 to a predefined angular position (arrow fn).

Figure 5:
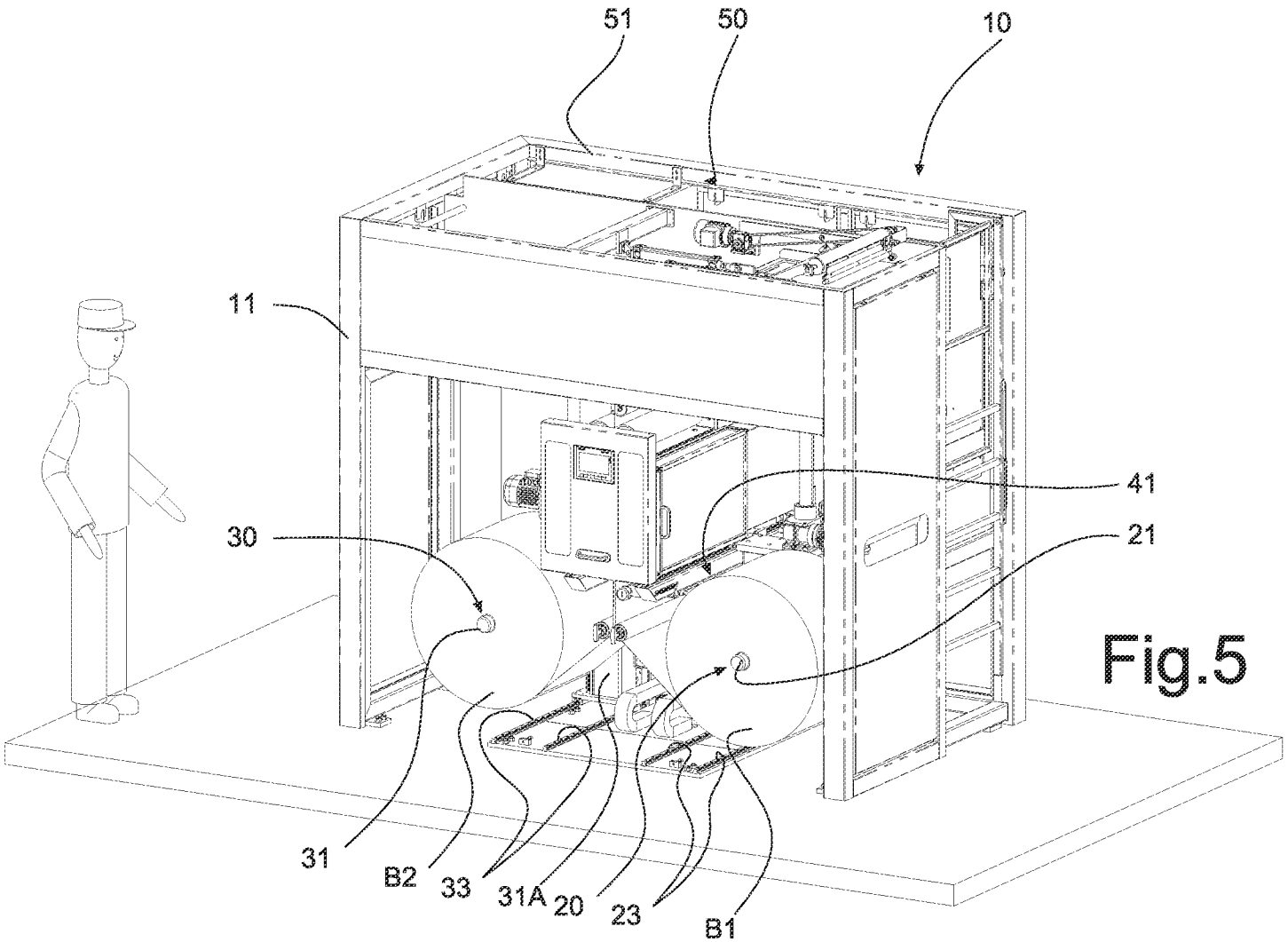

The operator then returns the single unit formed by the second roll-holder assembly 30 and of the splicing assembly 40 to the unwinding zone A (FIGS. 2, 4 and from 9E to 9H). Advantageously, a further pneumatic piston is present, connected between the fixed frame and the splicing assembly (without position control), which acts as counterweight and allows the operator to effortlessly move the unit formed by the roll-holder and splicing assembly; moreover, the operator moves the splicing assembly by means of the handle 40.3 (indicated in FIG. 1); advantageously the valve that operates the pneumatic piston is also operated by means of said handle. Here the actuator of the automatic movement device 65 (which is part of the misalignment correction device 62 of the plies) is connected to the second roll-holder assembly 20 (FIGS. 2 and 5).

Figure 10:
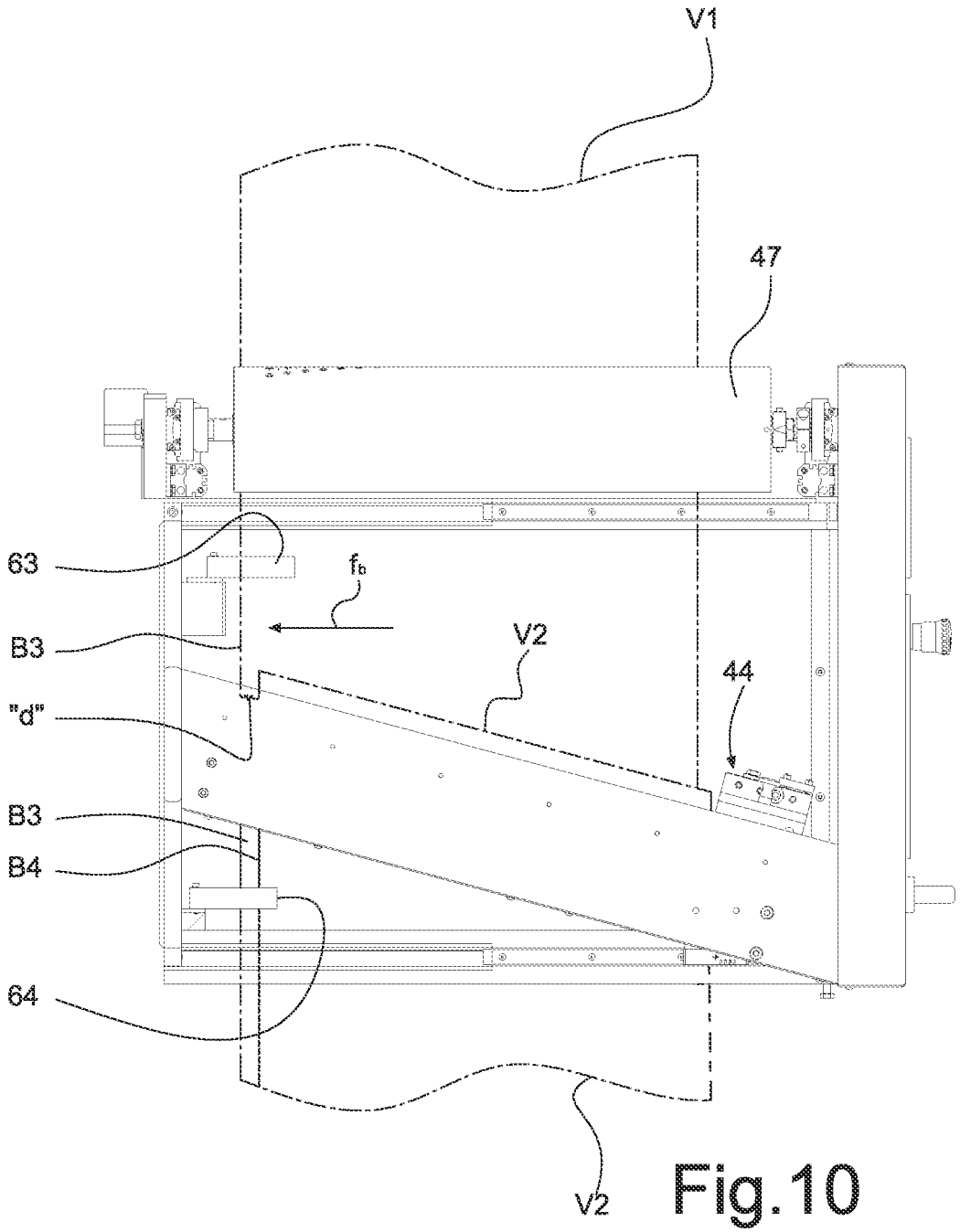
FIG. 10 represents a schematic view of the splicing zone of the splicing assembly during the step of aligning the edges of the plies being spliced.
Figure 11A:
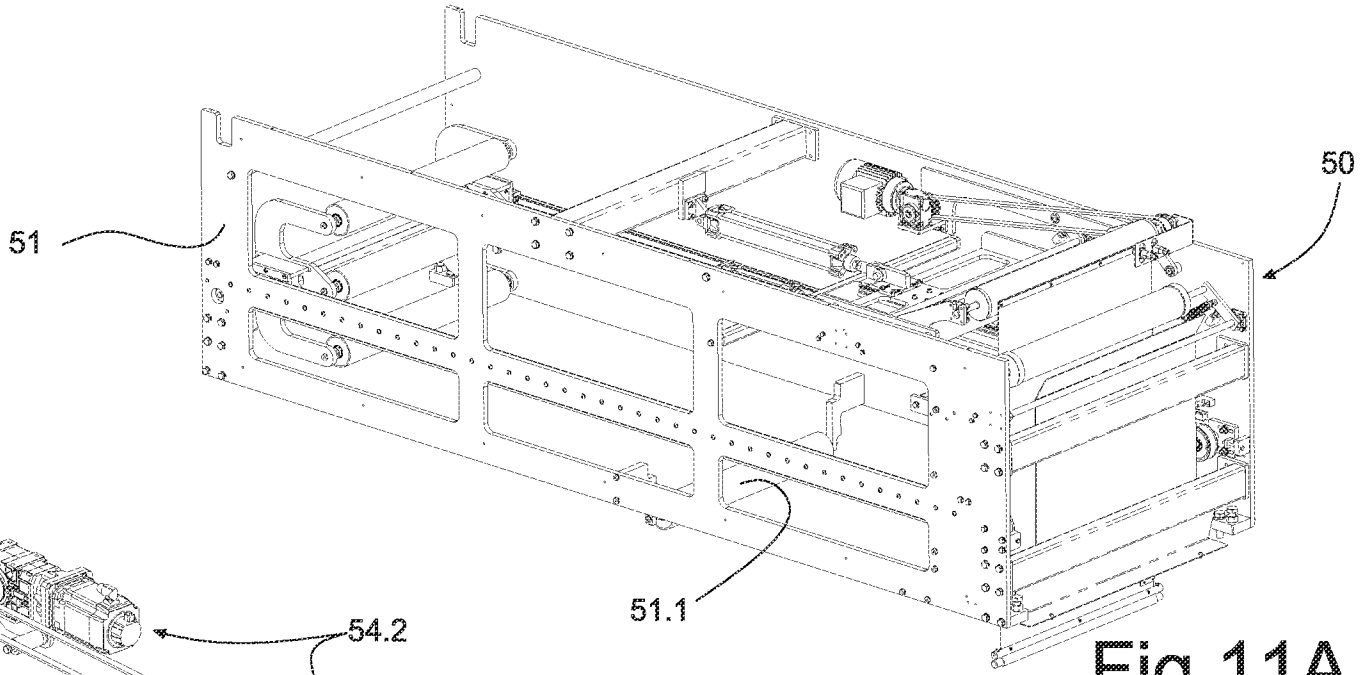
FIGS. 11A to 11E show schematic axonometric views of components of the accumulation unit of an unwinder according to the invention.
Figure 11B:
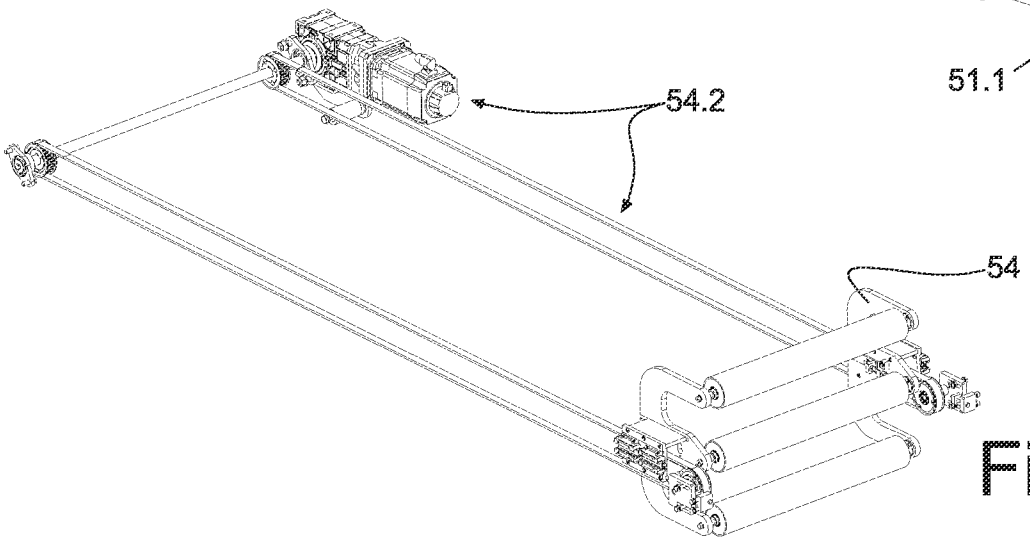
Figure 11C:
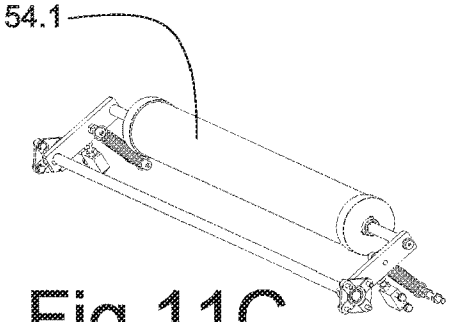
Figure 11D:
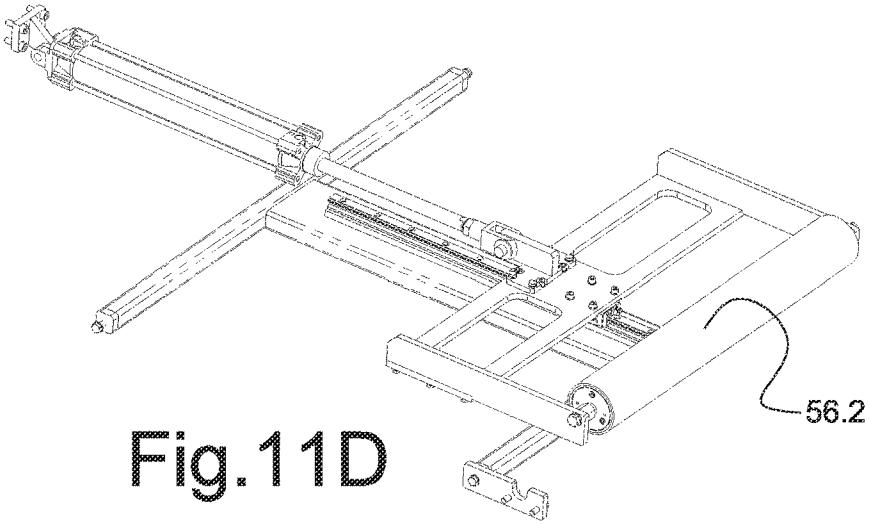
Figure 11E:
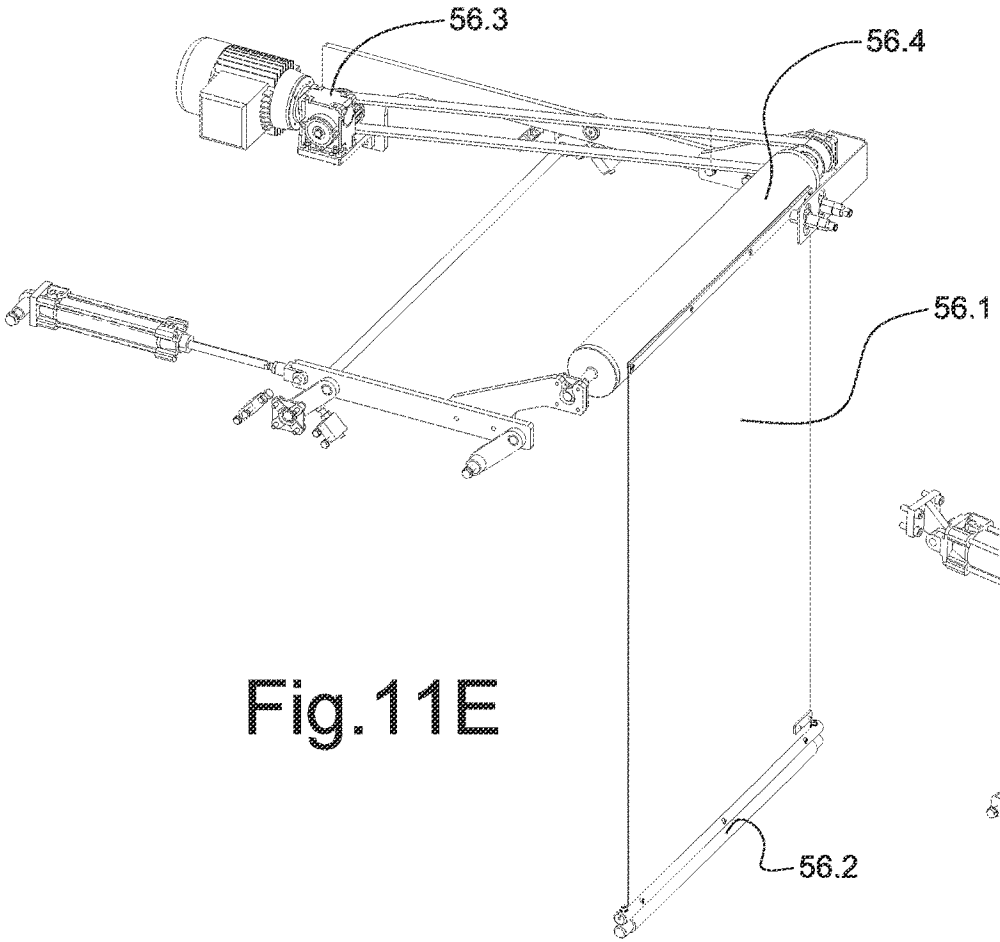

The first sensor 63 detects the position of the edge B3 of the ply being unwound, while the second sensor 64 detects the position of the edge B4 of the ply of the spare roll B2. If there is a misalignment "d" (as shown in FIG. 10), the system orders the actuator of the automatic movement device 65 to transversally move (arrow fb) the second roll-holder assembly 30 to bring it in line with the edge of the ply being unwound.

When the unwinding roll is about to run out, a further sensor, or the operator, starts the roll switching operation, and the movable trolley of the accumulation unit 50 is moved towards the first position, increasing the amount of ply accumulated in the overlapping accumulation sections 55.1 of the accumulation unit.

When this position in the accumulation unit has been reached, rotation of the unwinding roll is stopped, the accumulation unit continues to feed ply towards the printing machinery through the movement of the movable trolley towards its second position in the accumulation unit.

Figure 9E:
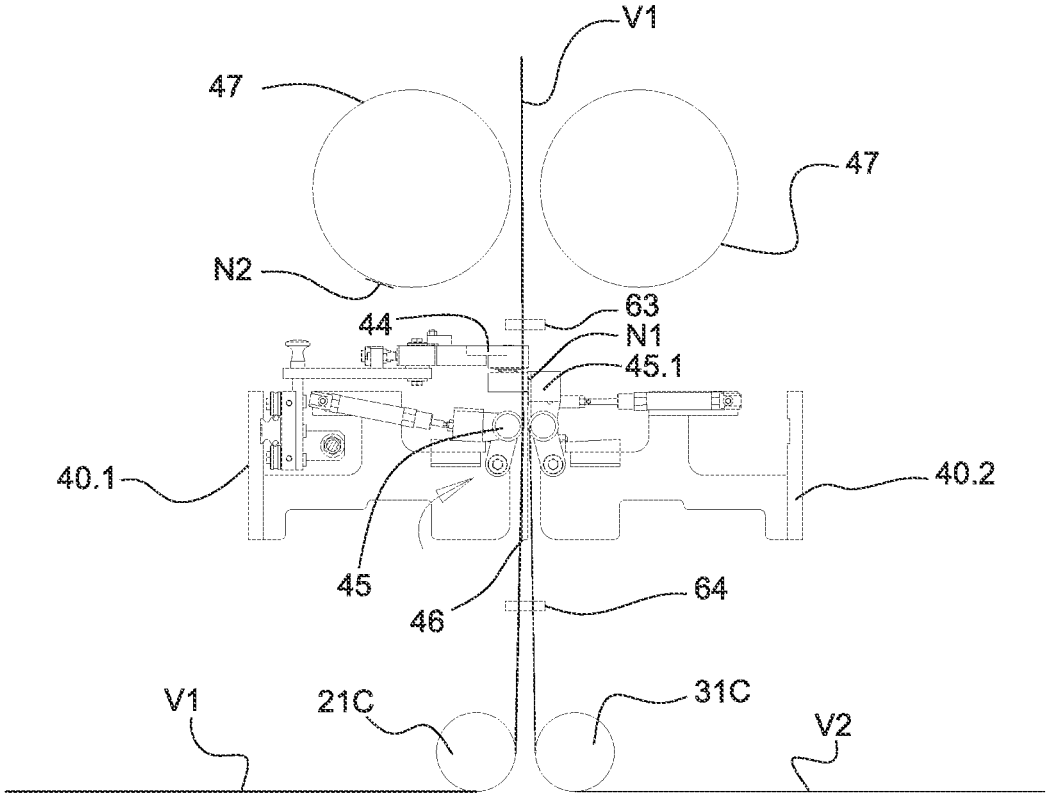
Figure 9F:
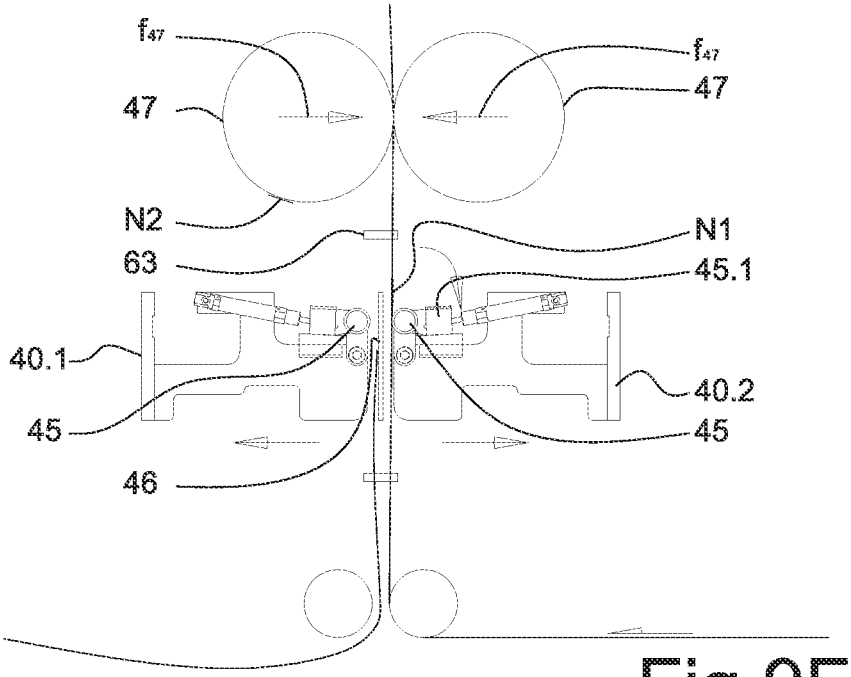
Figure 9G:
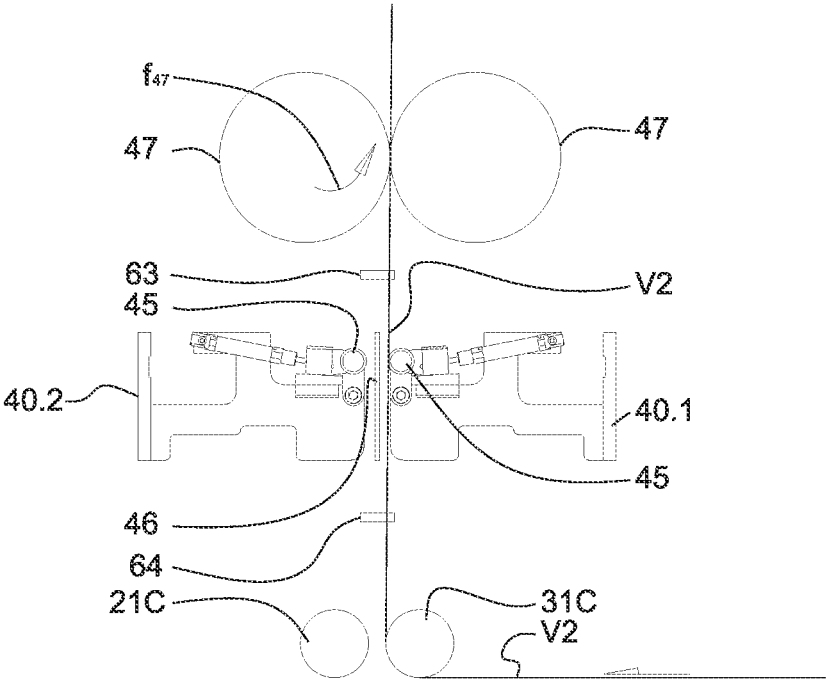

The pad of the contrasting device 45 of the splicing assembly 40 relating to the roll that was being unwound (part 40.1) is activated to block the ply V1 on the contrasting wall 46 (FIG. 9E). The cutting device 44 cuts the ply that was being unwound and the contrasting portion of the cutting device presses the cut ply against the first adhesive tape N1 previously positioned on the cut leading edge of the spare ply, thereby splicing the spare ply and the trailing edge of the ply being unwound.

The various contrasts are released (FIG. 9F) and the plies V1 and V2 thus spliced are free to move towards the accumulation unit 50. In the meantime, the aspirating rollers 47 are moved toward each other (arrows f47)

Figure 13:
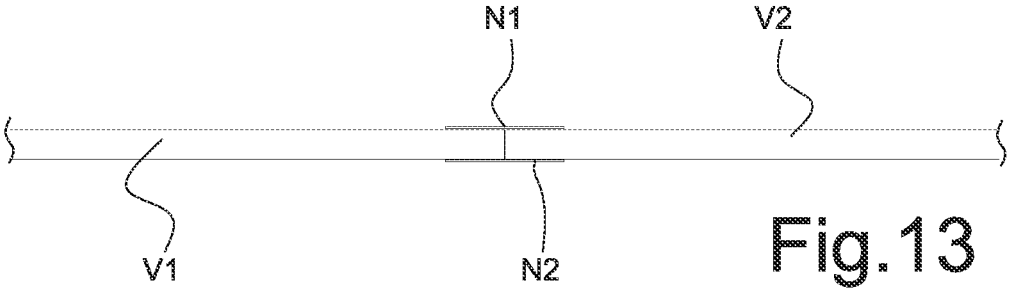
FIG. 13 represents a schematic side view of the splicing of two plies carried out with the splicing assembly of an unwinder according to the invention.

With the rotation of the relative aspirating roller 47 (arrow fn in FIG. 9G) the second adhesive tape N2 is rotated at the splicing zone of the two plies, on the opposite side with respect to the first tape N1, which in the meantime has been moved between the aspirating rollers 47, thus implementing the function as shown in FIG. 13.

It must be noted that the splice of the leading/trailing edge of the two plies is of the type without overlapping edges, i.e., the two end edges of the trimmed plies are placed one after the other, without being overlapped, with the two adhesive tapes positioned along the edges on opposite sides of the plies. This type of splicing is particularly useful in the case of plies to be used with printing machinery.

Figure 9H:
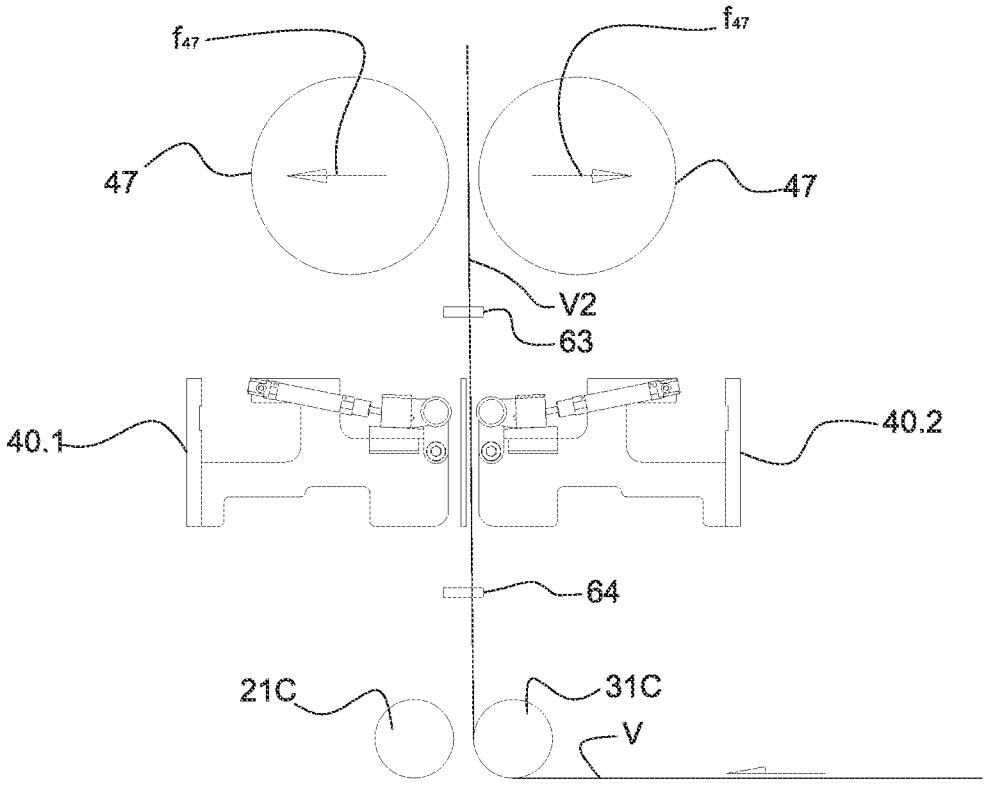

The aspirating rollers 47 are moved away, with the roll B2 that has become the new unwinding roll (FIG. 9H).

It is understood that the illustration merely represents possible non-limiting embodiments of the invention, which can vary in forms and arrangements without departing from the scope of the concept on which the invention is based. Any reference numbers in the appended claims are provided purely to facilitate reading thereof in the light of the description above and of the accompanying drawings and do not limit the scope of protection in any way.

The invention claimed is:

1. An unwinder of a thin ply product wound on a roll, of the type with automatic switching of the unwinding roll with a spare roll, said unwinder comprising:

a first roll-holder assembly equipped with a first unwinding rod for a respective roll, on which the roll is adapted to be supported, and which has an axis of rotation that is transverse to the direction of movement of the ply unwound from the roll;

a second roll-holder assembly equipped with a second unwinding rod for a respective roll, on which the roll is adapted to be supported, said second rod being parallel to said first unwinding rod of the first roll-holder assembly, said second roll-holder assembly facing said first roll-holder assembly in an unwinding zone, wherein of said two roll-holder assemblies, one assembly holds the unwinding roll and the other assembly holds the spare roll to be switched;

a ply splicing assembly placed above said first and second facing roll-holder assemblies;

a ply accumulation unit to allow automatic switching between a roll being unwound in one said roll-holder assembly and a spare roll provided in the other roll-holder assembly;

a transversal position correction system for the side edges of the plies on the rolls present in said roll-holder assemblies;

wherein said transversal position correction system for the side edges of the plies of the rolls present in said roll-holder assembly comprises a device for aligning a side edge of the leading edge of the ply on the spare roll with a corresponding side edge of the ply on the unwinding roll when both rolls are in said unwinding zone, which in turn comprises a device for verifying the alignment of said side edges of the spare roll and the unwinding roll, and a device for correcting any misalignment detected.

2. The unwinder according to claim 1, wherein said transversal position correction system for the side edges of the plies on the rolls present in said roll-holder assemblies comprises an automatic guide device for the side edge of the ply on the unwinding roll, adapted to enable said edge to maintain a substantially constant axial position during unwinding.

3. The unwinder according to claim 2, wherein said automatic guide device comprises at least one sensor adapted to detect the position or presence in a certain position of the edge of the ply on the unwinding roll, said at least one sensor being associated with a pre-determined optimal position for the edge of the ply during unwinding; said automatic guide device further comprises a device for changing the axial position of the unwinding rod, adapted to move the rod in a direction and for a distance such as to return the side edge to the optimal position in the event that said first sensor detects a position that does not conform with the optimal position.

4. The unwinder according to claim 3, wherein said device for changing the axial position of the unwinding rod comprises a movement actuator for said roll-holder assembly with the unwinding roll.

5. The unwinder according to claim 1, wherein said edge alignment verification device comprises at least one first sensor adapted to detect the position or presence in said position of the edge of the ply on the unwinding roll, and at least one second sensor adapted to detect the position or presence in a certain position of the edge of the leading edge of the spare roll which has to be spliced.

6. The unwinder according to claim 5, wherein said misalignment correction device comprises a system for moving the spare roll in the direction of correction.

7. The unwinder according to claim 6, wherein said system for moving the spare roll in the direction of correction provides the movement of the unwinding rod, on which the spare roll is mounted, in an axial direction by an amount equivalent to the misalignment measurement; said system for moving the spare roll in the direction of correction comprises a system for the lateral movement of one said unwinding rod with respect to said unwinding zone, to enable the translation in a transversal direction of the roll-holder assembly with the spare roll.

8. The unwinder according to claim 5, wherein said at least two sensors are operationally connected to an electronic unwinder control system, and upon said electronic unwinder control system verifying that the two edges are not in the same position or are not aligned, said electronic unwinder control system orders said misalignment correction device to change the position of one of the two edges so as to change the position of the edge of the leading edge of the ply on the spare roll which has to be spliced with the ply on the unwinding roll.

9. The unwinder according to claim 1, further comprising an automatic movement device for said unwinding rod.

10. The unwinder according to claim 9, wherein said automatic movement device comprising an actuator acting on the support frame of the respective roll-holder assembly in order to translate the support frame with the unwinding rod by an amount equivalent to the misalignment correction measurement; and the unwinder comprises one said movement system for each said roll-holder assembly so as to correct the positioning of the roll when it is a spare roll, there being thus present one said automatic movement device for each roll-holder assembly.

11. The unwinder according to claim 1, wherein said splicing assembly can be moved from a working position above the two said roll-holder assemblies in said unwinding zone, to a working position above an extracted roll assembly in the loading zone, to allow preparation for splicing of the leading edge of the ply wound on the spare roll.

12. The unwinder according to claim 11, wherein said splicing assembly comprises an apparatus for moving the assembly from the working position in said unwinding zone to the other working position above said roll-holder assembly moved from the working zone.

13. The unwinder according to claim 1, wherein said ply accumulation unit comprising a ply accumulation path comprises a plurality of accumulation sections overlapping at least in part, between deviator rollers for the ply, and a ply feed apparatus downstream of the accumulation unit, wherein, downstream of the accumulation unit, feeding of the ply contained in said accumulation sections is achieved by varying the length of at least some of said accumulation sections, said accumulation unit also comprising a section for the insertion of the leading edge of the ply to be accumulated, between at least some of the deviator rollers of said accumulation path and a device for the automated insertion of the leading edge of the ply to be accumulated in said insertion section.

14. The unwinder according to claim 13, wherein said ply feed apparatus downstream of the accumulation unit comprises a first series of fixed deviator rollers, whose axes of rotation lie on a first surface, and a second series of deviator rollers placed on a movable trolley, whose axes of rotation lie on a second surface, said trolley being movable from a first maximum accumulation position, wherein said second series of rollers is spaced from said first series of rollers, with said second surface positioned on a first side of said first surface, and a second position in which said second series of rollers is arranged close to said first series, with said second surface positioned on the second side of said first surface opposite the first side, so that feeding downstream of the accumulation unit is achieved by moving said trolley from said first position towards said second position; wherein said section for insertion of the leading edge of the ply on the roll to be unwound is between said first and second series of rollers when in said second position, so that when the leading edge of the ply has passed said insertion section, said trolley is adapted to be moved to said first position with said second series of rollers that pull the ply towards said second position, thereby creating said accumulation sections.

* * * * *